US006820391B2

(12) United States Patent
Barmore et al.

(10) Patent No.: US 6,820,391 B2
(45) Date of Patent: Nov. 23, 2004

(54) APPARATUS FOR MAKING A RECLOSABLE POUCH

(75) Inventors: Charles R. Barmore, Moore, SC (US); Timothy G. Caudle, Simpsonville, SC (US)

(73) Assignee: Cryovac, Inc., Duncan, SC (US)

( * ) Notice: Subject to any disclaimer, the term of this patent is extended or adjusted under 35 U.S.C. 154(b) by 0 days.

(21) Appl. No.: 10/339,589

(22) Filed: Jan. 9, 2003

(65) Prior Publication Data

US 2003/0100424 A1 May 29, 2003

Related U.S. Application Data

(62) Division of application No. 09/495,083, filed on Jan. 31, 2000, now abandoned.

(51) Int. Cl.[7] ..... B65B 61/20

(52) U.S. Cl. ..... 53/133.4; 53/133.5; 53/135.2; 53/139.2; 493/114; 493/394

(58) Field of Search ..... 53/133.4, 133.5, 53/135.2, 135.3, 139.2; 493/114, 394, 927, 93, 94, 96, 99, 102

(56) References Cited

U.S. PATENT DOCUMENTS

| | | | | |
|---|---|---|---|---|
| 4,332,344 A | | 6/1982 | Strodthoff | 229/62 |
| 4,617,683 A | * | 10/1986 | Christoff | 383/63 |
| 4,874,126 A | * | 10/1989 | Miller | 229/160.2 |
| 5,024,537 A | | 6/1991 | Tilman | 383/63 |
| 5,046,300 A | * | 9/1991 | Custer et al. | 53/412 |
| 5,364,189 A | | 11/1994 | Kuge et al. | 383/63 |
| 5,392,589 A | * | 2/1995 | Buchanan | 53/412 |
| 5,540,358 A | | 7/1996 | Wiles et al. | 222/107 |
| 5,576,038 A | | 11/1996 | Moore et al. | 426/127 |
| 5,782,733 A | | 7/1998 | Yeager | 493/213 |
| 5,788,378 A | | 8/1998 | Thomas | 383/63 |
| 5,806,983 A | | 9/1998 | Million et al. | 383/113 |
| 5,823,933 A | | 10/1998 | Yeager | 493/213 |
| 5,829,884 A | | 11/1998 | Yeager | 383/61 |
| 5,902,047 A | | 5/1999 | Yeager | 383/203 |
| 5,913,496 A | | 6/1999 | Valdez | 248/99 |
| 5,938,339 A | | 8/1999 | Ouchi | 383/63 |
| 5,941,643 A | | 8/1999 | Linkiewicz | 383/210 |
| 5,983,594 A | * | 11/1999 | Forman | 53/133.5 |
| 6,019,512 A | | 2/2000 | Yeager | 383/203 |
| 6,030,123 A | | 2/2000 | Mitarai | 383/63 |
| 6,132,089 A | | 10/2000 | Galomb et al. | 383/63 |
| 6,164,826 A | | 12/2000 | Petkovsek | 383/210 |
| 6,186,663 B1 | | 2/2001 | Ausnit | 383/63 |
| 6,213,645 B1 | | 4/2001 | Beer | 383/211 |
| 6,270,257 B1 | | 8/2001 | Yeager | 383/203 |
| 6,325,543 B1 | | 12/2001 | Ausnit | 383/63 |

FOREIGN PATENT DOCUMENTS

| | | |
|---|---|---|
| EP | 000555170 A1 | 8/1993 |
| JP | 01294448 | 11/1989 |
| JP | 405097151 A | 4/1993 |
| JP | 405305956 | 11/1993 |
| JP | 08258849 A | 2/1997 |
| JP | 9174719 A | 7/1997 |
| WO | WO 99/59872 | 11/1999 |

* cited by examiner

*Primary Examiner*—Eugene Kim
*Assistant Examiner*—Sameh H. Tawfik
(74) *Attorney, Agent, or Firm*—Mark B. Quatt

(57) ABSTRACT

A reclosable pouch includes a base portion; a plurality of walls, the walls in communication with the base portion; a top portion, the top portion in communication with the walls; a discrete panel; and a reclosable zipper. An apparatus for making the pouch, and a method of making the pouch, are also disclosed.

4 Claims, 24 Drawing Sheets

APPARATUS FOR MAKING A RECLOSABLE POUCH

CROSS REFERENCE TO RELATED APPLICATION

This application is a divisional application of, and claims the benefit of, U.S. patent application Ser. No. 09/495,083 filed on Jan. 31, 2000; abandoned, on Jun. 12, 2003.

FIELD OF THE INVENTION

This invention relates to a reclosable pouch. The pouch is preferably made in a vertical form/fill/seal process.

BACKGROUND OF THE INVENTION

Vertical form/fill/seal (VFFS) packaging systems have proven to be very useful in packaging a wide variety of food and non-food pumpable and/or flowable products. An example of such systems is the Onpack™ flowable food packaging system marketed by Cryovac/Sealed Air Corporation. The VFFS process is known to those of skill in the art, and described for example in U.S. Pat. Nos. 4,589,247 (Tsuruta et al), U.S. Pat. No. 4,656,818 (Shimoyama et al.), U.S. Pat. No. 4,768,411 (Su), and U.S. Pat. No. 4,808,010 (Vogan), all incorporated herein by reference in their entirety. In such a process, lay-flat thermoplastic film is advanced over a forming device to form a tube, a longitudinal (vertical) fin or lap seal is made, and a bottom end seal is made by transversely sealing across the tube with heated seal bars. A flowable product is introduced through a central, vertical fill tube to the formed tubular film. The pouch is then completed by sealing the upper end of the tubular segment, and severing the pouch from the tubular film above it. The process can be a two-stage process where the creation of a transverse heat seal occurs at one stage in the process, and then, downstream of the first stage, a separate pair of cooling/clamping means contact the just-formed transverse heat seal to cool and thus strengthen the seal. In some VFFS processes, an upper transverse seal of a first pouch, and the lower transverse seal of a following pouch, are made, and the pouches cut and thereby separated between two portions of the transverse seals, without the need for a separate step to clamp, cool, and cut the seals. A commercial example of an apparatus embodying this more simplified process is the Onpack™ 2050A VFFS packaging machine marketed by Cryovac/Sealed Air Corporation.

A specific type of VFFS pouch is the gusseted pouch, which often functions as a box-type stand-up pouch or bag. Packaging machines, such as those supplied by Rovema, Bosch, and UVA-Butler, are commercially available. These machines sometimes include, or can be modified to include, devices that produce an edge seal, or plurality of edge seals, to provide rigidity to the final pouch. This feature allows the pouch to function more effectively as a box-type stand-up pouch. This feature also improves the aesthetics of the final pouch. One configuration allows for a final pouch having a flat bottom and a gable top portion. Some commercially available gusseted pouches have a zipper installed at the top portion of the pouch.

"Zipper" herein refers to a plastic reclosable fastener conventionally used as a closure device for a package. These zippers have male and female fastener elements in the form of reclosable interlocking rib and groove elements that permit the package to be opened, closed, and reopened, i.e. provide reclosability. Two popular types of zippers are the "pinch" zipper, in which the male and female components are pressed together manually to close the zipper, and the "slide" zipper, in which a typically semi-rigid slider is installed on the zipper, and is run transversely along the length of the zipper to close the zipper. Examples of the pinch zipper are disclosed in U.S. Pat. Nos. 5,059,036 (Richison et al.), U.S. Pat. No. 5,147,272 (Richison et al.), and U.S. Pat. No. 5,147,272 (Richison et al.) all incorporated herein by reference in their entirety. An example of the slide zipper is U.S. Pat. No. 5,007,143 (Herrington), incorporated herein by reference in its entirety. A typical zipper is one which has a groove or other indentation installed on the surface of a first member, and a rib or other protrusion on the surface of a second member, which rib or other protrusion can interlock into the groove or other indentation when the first and second members are pressed together. Alternatively, a first member having a plurality of grooves or other indentations installed on the surface thereof, and a second member having a plurality of ribs or other protrusions, can interlock when the first and second members are pressed together. In this alternative case, there may be no substantial difference in appearance between the two members, as the ribs may simply be the intervals between grooves on a strip which may lock into another of the same kind. More generally, some form of male/female interengagement is used to join two surfaces together. The interlocking members will typically be manufactured such that a flange is present around the border of the members. This flange essentially carries the interlocking portions of the overall zipper, and facilitates attachment by heat sealing, gluing, or other means of adhesion to the package of which the zipper forms the closure feature. Zippers are commercially available that are coated with a coating to enhance or inhibit adhesion of the zipper to selected materials with which the zipper will be associated. Those skilled in the art will be acquainted with reclosable plastic zipper technology.

The inventors have found that a discrete panel, preferably a semirigid panel, can be applied in a lay-flat condition to a lay-flat film prior to or simultaneously with the lay-flat film being formed and sealed into a pouch on a VFFS unit. The application of the panel can be done where the film is manufactured, or alternatively where the film is converted into tubing at a food processor location. A reclosable zipper is installed on the panel after the lay-flat film is formed into a tube and filled, thus providing a reclosable feature in a pour spout in the finished gusseted pouch. A pouch in the form of a pre-formed bag, with a panel as disclosed herein affixed thereto, can be supplied to the processor for filling, sealing, and application of the reclosable zipper. Alternatively, a pouch in the form of a pre-formed bag, with a panel and zipper as disclosed herein affixed thereto, can be supplied to the food or other processor for filling and sealing.

The panel serves at least four functions.

First, it adds stiffness or rigidity when using the pour spout to dispense product from the pouch. This feature enhances the effectiveness of the spout.

Second, it blocks internal seals as needed during the sealing process to insure that an applied zipper will properly function as a reclosable feature.

Third, the panel acts as a carrier for a peelable seal. In this embodiment, one surface of the panel can itself function as a peelable seal. Alternatively, a separate component can be adhered or affixed to one surface of the panel, which component functions as a peelable seal. The peelable seal can optionally function as a tamper evident seal. The peelable seal can be hermetic, or for some applications, such as dog food bags, can include a path within the seal for venting of gases from the interior of the bag.

Fourth, the panel carries or supports the reclosable zipper.

SUMMARY OF THE INVENTION

In a first aspect, a reclosable pouch comprises a base portion; a front wall, two side walls, and a back wall, the walls in communication with the base portion; a top portion, the top portion in communication with the walls; a discrete panel adhered to an interior of at least one of the walls in the top portion; and a reclosable zipper.

In a second aspect, an article comprises a lay-flat film having a first lateral edge and a second lateral edge; and a plurality of lay-flat discrete panels attached to the lay-flat film at regular spaced intervals along the length of the film, each panel spaced the same distance from the first lateral edge of the lay-flat film, each panel spaced the same distance from adjacent panels, and each panel adapted to accommodate a reclosable zipper.

In a third aspect, a method for making a reclosable pouch with a reclosable zipper comprises providing a lay-flat film having a first lateral edge and a second lateral edge; attaching a plurality of lay-flat discrete panels to the lay-flat film at regular spaced intervals along the length of the film, each panel spaced the same distance from the first lateral edge of the lay-flat film, each panel spaced the same distance from adjacent panels, and each panel adapted to accommodate a reclosable zipper; forming the film into a tube; sealing the film with a longitudinal seal; forming a bottom seal; filling the tube with a product; and sealing the tube to form a pouch wherein the pouch includes a a discrete panel and a reclosable zipper.

In a fourth aspect, an apparatus for making a pouch comprises means for providing a lay-flat film having a first lateral edge and second lateral edge; means for attaching a plurality of lay-flat discrete panels to the lay-flat film at regular spaced intervals along the length of the film, wherein each panel is spaced the same distance from the first lateral edge of the lay-flat film, each panel is spaced the same distance from adjacent panels, and each panel is adapted to accommodate a reclosable zipper; means for forming the lay-flat film into a tube; means for longitudinally sealing the tube; means for forming a bottom seal on the tube; means for filling the tube with a product; means for sealing a top portion of the tube to form a pouch wherein the pouch includes a discrete panel, and a reclosable zipper.

In a fifth aspect, a method for making a reclosable pouch with a reclosable zipper comprises providing a lay-flat film having a first lateral edge and a second lateral edge; attaching a plurality of lay-flat discrete panels to the lay-flat film at regular spaced intervals along the length of the film, each panel spaced the same distance from the first lateral edge of the lay-flat film, each panel spaced the same distance from adjacent panels, and each panel adapted to accommodate a reclosable zipper; forming the film into a tube; sealing the film with a longitudinal seal; and forming a bottom seal.

In a sixth aspect, a method for making a reclosable pouch with a reclosable zipper comprises providing a lay-flat film having a first lateral edge and a second lateral edge; attaching a plurality of lay-flat discrete panels to the lay-flat film at regular spaced intervals along the length of the film, each panel spaced the same distance from the first lateral edge of the lay-flat film, each panel spaced the same distance from adjacent panels, and each panel adapted to accommodate a reclosable zipper; forming the film into a tube; sealing the film with a longitudinal seal; and installing the reclosable zipper on one end of the tube.

BRIEF DESCRIPTION OF THE DRAWINGS

The present invention is illustrated by reference to the following drawings, encompassing different views of various embodiments of the invention, wherein.

DETAILED DESCRIPTION OF THE INVENTION

The invention can be used to produce a pouch with a reclosable feature either in a front wall or a side wall of the pouch.

In a first preferred embodiment, a zipper is installed along the top portion of the gusseted pouch. The zipper, along with the panel and top of the front wall, forms a wide mouth reclosable pouch. The zipper is preferably installed after the pouch has been formed and filled. The zipper can be a "pinch" type or "slide" type zipper, and can be installed externally or internally at the top portion of the pouch.

In a second preferred embodiment, a zipper is installed in a side gusset formed in one of the side walls of the pouch. The zipper, along with the panel and top of the side wall, forms a narrow mouth reclosable pouch. The zipper is installed after the pouch has been formed and filled. Alternatively, the zipper can be adhered to a discrete panel to form a zipper/panel combination. This combination can then be installed on the lay-flat film before the lay-flat film is formed into a tube.

A peelable seal can be installed in a pouch of the invention either above or below the zipper. In some applications, this feature is highly desirable. In other applications, e.g. when used in conjunction with a slide zipper, or when used in connection with a pinch zipper which does not have a hermetic seal, the peelable seal is a necessary part of the pouch.

The following drawings and description provide further details of each of these embodiments.

EXAMPLE 1

Side Wall Reclosable Pouch

Figure 1:
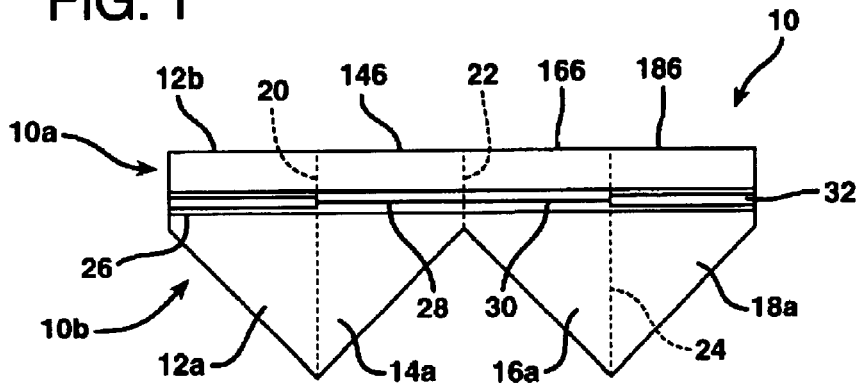
FIG. 1 is a plan view of a panel capable of being formed into a pour spout.

FIG. 1 shows in plan view a discrete split panel 10 having sections 10*a* and 10*b*. Panel 10 can be made from a material such as poly (vinyl chloride) (PVC) or other plastic or polymeric material. The discrete panel 10 is preferably semi-rigid. The term "semi-rigid" is used herein to define a panel that provides added stiffness or rigidity, however small the addition, to a pour spout ultimately formed on the top portion of a gusseted or non-gusseted pouch, or in the side gusset of a gable top gusseted pouch. A panel will preferably be polymeric in composition, with a thickness of between 0.1 and 100 mils. A preferred material is poly (vinyl chloride) or a polyolefin, polyester, or polycarbonate, or copolymers thereof.

The panel of the invention will also preferably comprise, carry, or include a portion made of a material that will form a low seal strength, peelable, hermetic seal when processed as disclosed herein. Thus, in gusseted embodiments of pouches of the invention, at least a portion of the gusset is preferably peelably sealed together. This provides a neat, aesthetically appealing pouch.

Panel section 10*a* includes sections 12*a*, 14*a*, 16*a*, and 18*a*, and panel section 10*b* includes sections 12*b*, 14*b*, 16*b*, and 18*b*, these sections defined by fold lines 20, 22 and 24. A reclosable zipper includes a female interlock 26 and male interlock 28, and a male interlock 30 and female interlock 32. The fold lines provide the capability of folding the sections of the panel 10, attached to a lay-flat film, to form a pour spout in a manner described in more detail below. The spout when formed can be opened and reclosed as desired by manipulation of the zipper.

Figure 5:
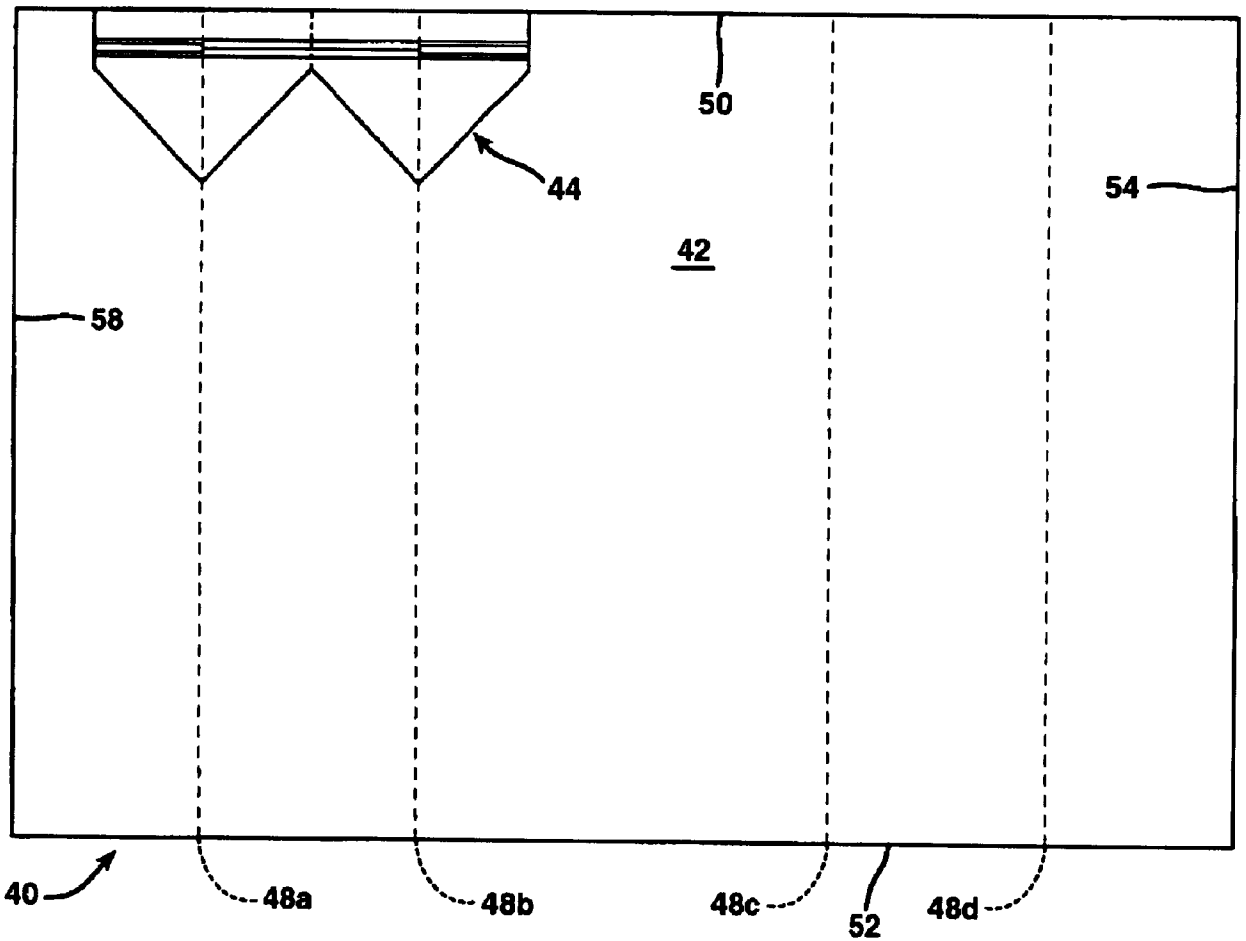
FIG. 5 a plan view of a lay-flat film with the panel of FIG. 1 installed thereon.

FIG. 5 shows in plan view a lay-flat film 42 with a discrete panel 44, like the panel 10 of FIG. 1, installed thereon. Also shown are fold lines 48*a*, 48*b*, 48*c*, and 48*d* respectively. The film 42 is defined by trailing edge 50 and leading edge 52, and lateral edges 54 and 56.

The panel 44 is preformed and applied to the flat web of film 42 prior to forming of the rollstock material into a tube which is eventually formed into a pouch. In the embodiment shown in FIG. 5, the lay-flat film optionally includes linear fold lines applied to the film. These fold lines are disposed with respect to each other such that a pouch constructed from the film in a VFFS process will take on a box-like appearance, and include front and rear walls to produce a gusseted pouch.

The panel preferably has incorporated into it both an easy open seal feature and a reclosable zipper. Other reclosable devices could also be used. The easy open seal feature is preferably based on the use of polymers which make peelable, hermetic seals when bonded to itself. The easy open, peelable hermetic seal can be applied either above or below the zipper. FIG. 5 shows the layout of the panel and fold lines as they would appear on the flat film 42 prior to forming into a pouch. The dotted lines within panel 44 represent the folds to accommodate a side gusset in the final pouch.

The panel 44 and fold lines 48*a* through 48*d* are applied to the flat film 42 to form a lay-flat film 40 with the panel attached. This process occurs preferably prior to, or simultaneously with, the introduction of film 40 to the forming shoe, forming collar, or other forming device of a vertical form/fill/seal machine. The panel can be applied to the film 42 by any suitable means, for example by heat, radio frequency (RF) sealing, or adhesive. The panel is applied to the side of the film 42 that will ultimately form an inside surface of the gusseted gable top pouch that results. This eliminates any interference with printing on the outside surfaces.

The panel is positioned on the film so that when the pouch is formed, the panel is located in one of the side gussets. The film 40, with the panel attached, travels over the forming shoe of a vertical form/fill/seal machine and down over a mandrel to form a tube. A vertical or longitudinal seal is applied to the back panel of the now tubular film. The film then moves further downward to a sealing position. As the gusset is formed, the panel is folded inwardly. A heat seal is applied across the discrete panel. The seal strength of the portion of the gusset containing the discrete panel is selected to meet the easy-open criteria. The seal strength of a first surface of the discrete panel to the gusset, or the seal strength of a portion of a first surface of the discrete panel to the gusset, is relatively low, thus forming a peelable seal. A "peelable seal" herein is characterized by (1) a seal strength of less than or equal to 2.5 lb/inch, and preferably between 0.001 and 2.5 lb/inch, more preferably between 0.001 and 2.5 lb/inch, even more preferably between 0.005 and 2 lb/inch, and most preferably between 0.01 and 1.5 lb/inch; a peel force falling within these ranges provides a balance between sufficient adhesion to prevent premature film separation, and sufficient peelability so that two portions can be separated without tearing or otherwise compromising the materials; a peel force of more than about 2.5 lb/inch results in an interface that is more difficult to separate; on the other hand, a peel force of less than about 0.001 lb/inch creates a greater likelihood of premature delamination of the film ; and (2) by the formation of a hermetic seal, or alternatively a path for venting gases from the interior of the package. The seal strength of the area of the gusset not containing the panel is relatively high. As the spout is folded inward, the re-closure device is engaged. Additionally, a peelable tear tape is applied to the top portions on the exterior, of the spout seal area. This prevents inadvertent opening of the spout seal. The two flanges comprising the gusset are not sealed to each other. The tear tape can also be used to cover the U-shaped cut out or slit as described further herein.

The end user would tear the tear tape away, break the easy open seal, pull back two sections, and push the spout forward. The process of opening the spout is similar to that for opening a gable top paperboard carton. To close, the spout is pushed inward and the zipper components are interlocked.

The panel 44 is thus applied to the surface of the film 42 and eventually becomes part of the inner surface of the pouch.

The panel is configured so that during formation of the gable top, gusseted pouch, the panel becomes part of a side gusset at the top portion of the pouch.

Figure 2:
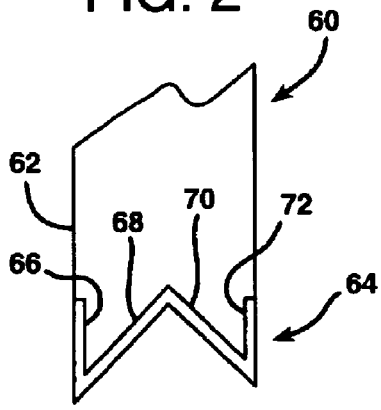
FIG. 2 is a schematic top plan view of a portion of a pouch in its unsealed condition.

FIG. 2 is the view of a discrete panel 64, equipped with a reclosable zipper, as viewed from inside the top portion of an open, formed gusseted pouch 60 before sealing of the top portion of the pouch. Packaging film 62, corresponding to film 40 of FIG. 5, is pictured as formed into a gusseted pouch. Panel 64 corresponds to panel 10 of FIG. 1, and panel 44 of FIG. 5. Panel sections 66, 68, 70, and 72 correspond to panel sections 12, 14, 16, and 18 respectively of FIG. 1. FIG. 2 shows the panel 64, now formed into part of a pour spout, installed in a side gusset of pouch 60. The opposite side of the top portion of the pouch (not shown) will typically also include a gusset which is sealed at the top portion of the pouch.

Figure 3:
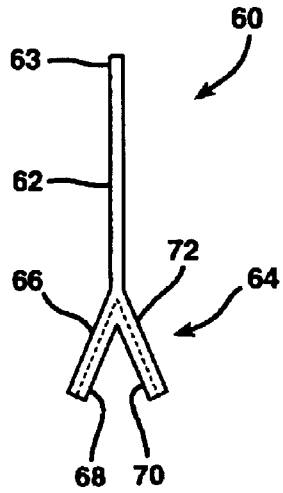
FIG. 3 is a schematic top plan view of a pouch in its sealed condition.
Figure 4:
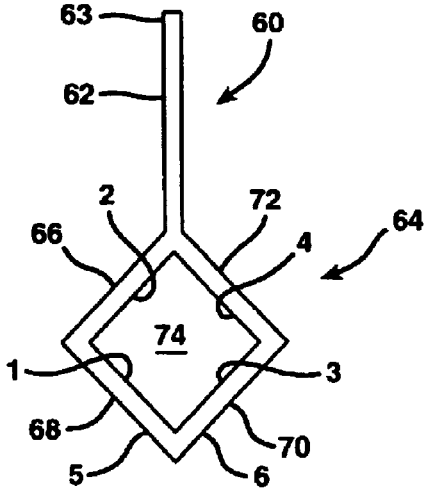
FIG. 4 is a schematic top plan view of a pouch in its sealed condition, but with the pour spout in an opened position.

FIG. 3 shows the top portion of the pouch 60 in a closed, sealed condition with a zipper in a closed condition. The top edges of packaging film 62, corresponding to film 42 of FIG. 5, are pictured as sealed together in the top middle portion of the gusseted pouch. Panel 64 corresponds to panel 10 of FIG. 1, and panel 44 of FIG. 5. Panel sections 66 and 68 are shown attached together. This attachment is accomplished by joining a rib section and groove section of a reclosable zipper. This occurs when female interlock 32 is installed on the inside surface of panel section 66, and male interlock 30 is installed on the inside surface of panel section 66, and these two interlocks are brought together. Likewise, panel sections 70 and 72 are shown attached together. This attachment is accomplished by joining a rib section and groove section of a re-closable zipper. This occurs when a male interlock 28 is installed on the inside surface of panel section 70, and female interlock 26 is installed on the inside surface of panel section 72, and these two interlocks are brought together. For the sake of clarity, the interlocks described above are not illustrated in FIGS. 2 through 4. FIG. 1 shows these interlocks. FIGS. 2 through 4 also do not disclose zipper flanges. These will be described in more detail below.

FIG. 4 shows the top portion of the pouch 60 in a closed, sealed condition, and with the panel 64 opened into a pour spout. The top edges of packaging film 62, corresponding to film 40 of FIG. 5, are pictured as sealed together in the top middle portion of the gusseted pouch. Orifice 74 represents the opening in the pour spout for access to the contents of pouch 60. A contained product, such as a beverage, powder, syrup, or other flowable product, can be dispensed or poured out through orifice 74. During the initial sealing process in the VFFS machine, an easy open seal is applied to the surfaces 1 and 2 to join them together, and to surfaces 3 and 4 to join them together. The seal between surfaces 5 and 6 is blocked (see also FIG. 3 at surfaces 68 and 70).

Figure 6:
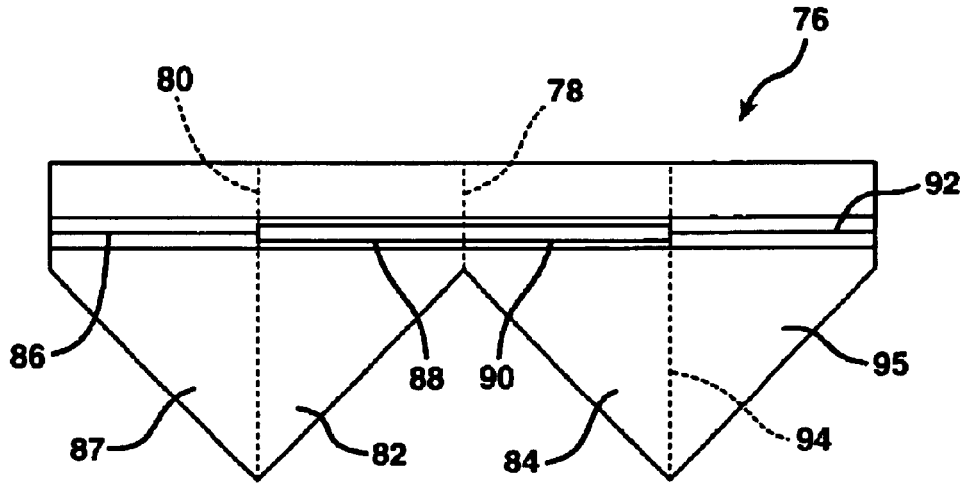
FIG. 6 is a plan view of an alternative embodiment of the panel of FIG. 1.
Figure 7:
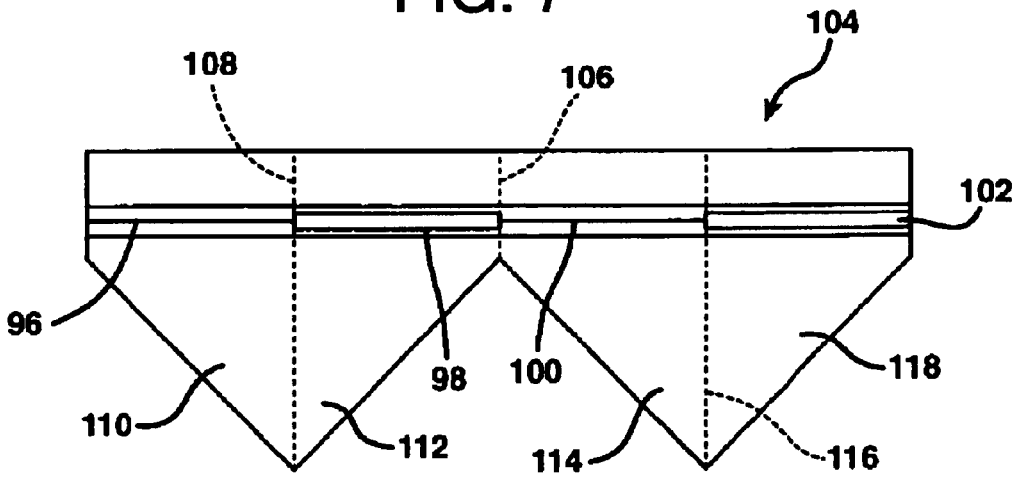
FIG. 7 is a plan view of another alternative embodiment of the panel of FIG. 1.

Those skilled in the art will understand, after a review of the present application, that other arrangements of the male and female interlocking zippers can be used with benefit. For example, although FIG. 1 shows male interlocks 28 and 30 disposed between female interlocks 26 and 32, these can be reversed. An illustration of this is shown in FIG. 6, where female interlocks 88 and 90 are positioned between male interlocks 86 and 92. As another example, FIG. 7 shows alternating female interlocks 98 and 102, and alternating male interlocks 96 and 100. In embodiments where a first zipper member has a plurality of grooves or other indentations installed on the surface thereof, and a second member has a plurality of ribs or other protrusions, the two members capable of interlocking when the first and second members are pressed together, and there being no significant difference in construction of the two members, the placement of interlocking members is less critical.

Those skilled in the art will understand, after a review of the present application, that the shape and size of the panel, and of the individual panel members, can be modified as needed to suit the particular size and shape of pouch that is to be made; the size and shape of the side gusset of which the panel will form a part when the pouch is made; the desired size and shape of the orifice 74 (see FIG. 4) of the pour spout formed from the panel in the side gusset of the pouch; and other factors. For example, in some embodiments disclosed herein, the panels are rectangular in shape. The size, shape, and placement of zippers installed on the panel can of course be adjusted accordingly.

EXAMPLE 2

Front Wall Reclosable Pouch With Internally Mounted Zipper

The discrete panel functions as a part of a pouch. The panel can be used to block the seal in a preferred area of the pouch when the top seals are applied, in order to provide a "wide-mouth" opening. The discrete panel can carry a device such as a reclosable zipper. In such an embodiment, a cut or tear away hermetic strip, or an easy open hermetic seal strip, is present in the pouch to provide hermeticity until such time as the pouch is to be opened. The cut or tear away hermetic strip, or an easy open hermetic seal strip, will typically be located above the zipper.

For the panel to perform these tasks, it must have one surface that will form a bond with at least one surface of the zipper flange as well as the pouch material that forms the package. The second surface of the panel must not permanently bond to either the zipper it is carrying or to the inner surfaces of the pouch material, other than providing an easy open peelable seal. The structure of the two materials would be A/A or A/C for the pouch film and A/C for the panel, where "A" defines a sealing surface of one type, and "C" defines a sealing surface of another type, and where A and C do not form a high strength seal with each other. With an A/A structure a fin or lap seal can be used for the back seam. With an A/C, only a fin seal can be made. Throughout this specification, like letters denote layers or surfaces that can be sealed together in a conventional manner; different letters denote layers or surfaces that cannot be sealed together in a conventional manner. As an example, the "A" layer or surface of a film will heat seal or otherwise seal to an "A" layer of a discrete panel, whereas the "A" layer or surface of a film will not heat seal or otherwise seal in a conventional manner to the "C" layer of a panel. The panel can be initially adhered to the portion of the lay-flat film that will ultimately form the inner surface of the front wall of the pouch. Thereafter, the panel can remain in that location.

Alternatively, upon the application of a heat seal device to the pouch in the area of the panel, the panel can be designed to transfer to the opposite side of the pouch, i.e. to the inner surface of the back wall of the pouch. The panel permits the sealing of inside surfaces of the gussets to the back panel but not to the front panel of the pouch without having to mechanically block the sealing of the two panels. This develops a wide mouth opening as illustrated in FIGS. 8 and 9.

Figure 8:
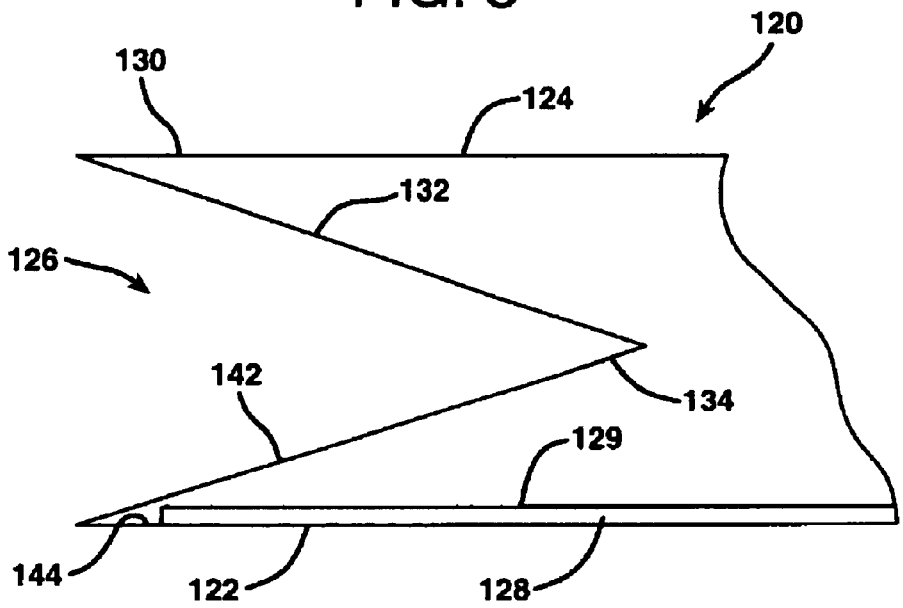
FIG. 8 is a top view of gusseted portion of a wide mouth pouch before sealing the top portion of the pouch.

FIG. 8 shows a pouch 120 having a discrete panel 128. The panel 128 has been preferably applied to the inner (product contact) surface of the pouch film prior to forming the film and drawing it down across the mandrel. Panel 128 has a first surface that bonds to the film surface that will become the inner surface of the front wall 122 of the pouch. Panel 128 has a second surface 129 that does not bond to the film surface that will become the inner surface of the back wall 124. Side gusset 126 defines opposing surfaces which seal to themselves.

Figure 9:
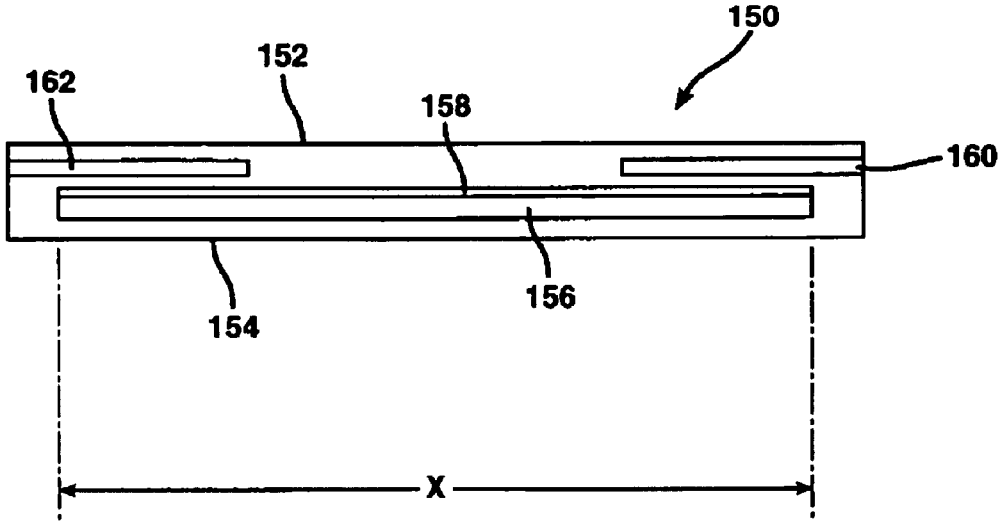
FIG. 9 is a top view a wide mouth pouch in a sealed condition.

FIG. 9 is a schematic top view of a package showing a panel 156 that is bonded to the inner surface of the front wall 154 of pouch 150. The panel 156 is not sealed to the inner surface of the back wall 152 of pouch 150. This unsealed area is represented by reference numeral 158. Side gussets 160 and 162 are sealed to the inner surface of the back wall 152. The two way arrow defined by "x" in FIG. 9 indicates the width of the pouch opening defined by the unsealed area 158. The panel can be of any suitable width, and can extend to each edge of the front wall.

This package can be made by a continuous or intermittent VFFS pouch making process. In some embodiments, a peelable seal can be applied above the discrete panel to help insure that a hermetic package is maintained until the pouch is opened by the end user.

Those skilled in the art will understand that for purposes of the invention, the arrangement of the panel and zipper, and any easy open peelable seal, with respect to the front wall or back wall is interchangeable; i.e. what has been described in a particular embodiment for the front wall could be done for the back wall. For example, instead of transferring the panel from the front to the back wall, the panel could be transferred from an initial position on the back wall to a position on the front wall. Alternatively, the panel can be adhered to the back wall of the pouch instead of the front wall (for a wide mouth pour spout) and remain in that position.

EXAMPLE 3

Front Wall Reclosable Pouch with Externally Mounted Zipper

Figure 10:
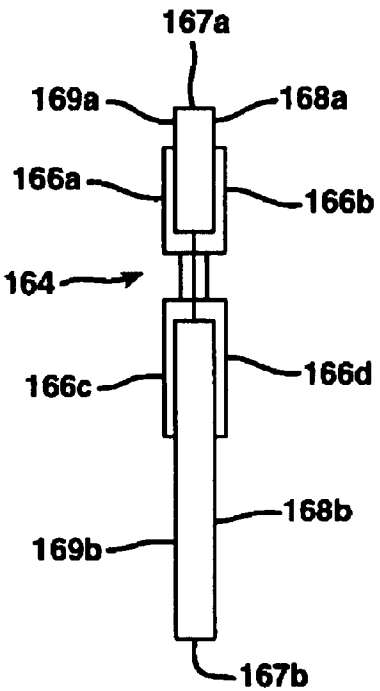
FIG. 10 is a view of a zipper attached to two panels.

Referring to FIG. 10, to transfer a "pinch" zipper, the zipper 164, with four flanges 166*a*, 166*b*, 166*c*, and 166*d* in the shape of an H, is sealed between a split panel 167 made up of panel segments 167*a* and 167*b*, preferably of the same construction. The zipper flanges comprise a material, or includes a first surface layer, that can be sealed to surfaces 168*a* and 168*b*, but not to surfaces 169*a* and 169*b*, of panel segments 167*a* and 167*b* respectively. The zipper flanges comprise a material, or includes a second surface layer, that cannot be sealed to surfaces 168*a* and 168*b*, but can be sealed to surfaces 169*a* and 169*b*, of panel segments 167*a* and 167*b* respectively. The side of each panel segment that seals to the zipper also seals to the pouch material. The split panel, with the zipper attached, is applied to the lay-flat film prior to advancing the film over the forming mandrel of a VFFS unit.

Figure 11:
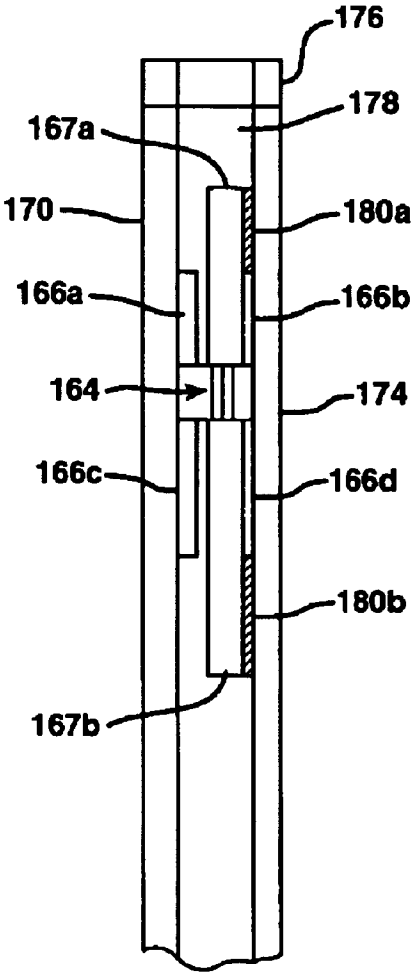
FIG. 11 is a view of a zipper attached to two panels.

FIG. 11 is a schematic edge view of a pouch (for a wide-mouth pouch) or a front view (of a side pour spout). The resulting seals are shown at 180*a* and 180*b* in FIG. 11. Zipper flanges 166*b* and 166*d* are sealed to the front wall 174 of the pouch (or front portion of a side pour spout). Zipper flanges 166*a* and 166*c* are not sealed to panel segments 167*a* and 167*b*, but are instead sealed to the back wall 170 of the pouch (or the back side of a side pour spout) or to gussets formed therein. Once the gussets are formed, but not sealed, a seal is applied to the top portion of the pouch containing the panel. This sealing step seals the gussets to the back wall 170 of the pouch (or the back side of a side pour spout) and transfers the flanges of the backside of the zipper, which are not sealed to the split panel 167, to the back wall of the pouch (see FIG. 11). Because the back surface of the split panel does not bond to the back wall of the pouch, the opening of the pouch and zipper extends the full width of the pouch. To make the pouch fully hermetic for distribution purposes, a seal 176 is applied above the panel leaving an unsealed strip 178 between this seal and the panel. To open, a cut or tear is made in the non-sealed strip 178.

EXAMPLE 4

Front Wall Reclosable Pouch with Externally Mounted Slide Zipper

Figure 12:
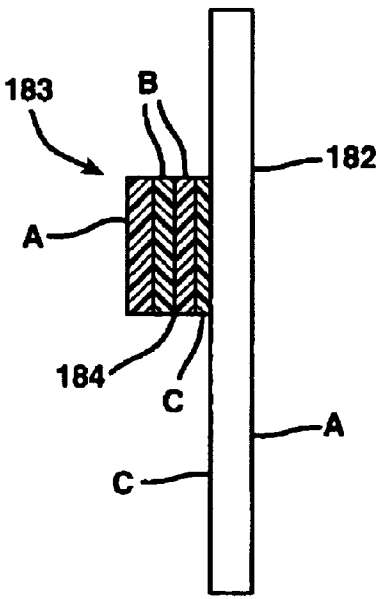
FIG. 12 is a top view of a panel attached to a film strip with an easy-open construction.
Figure 15:
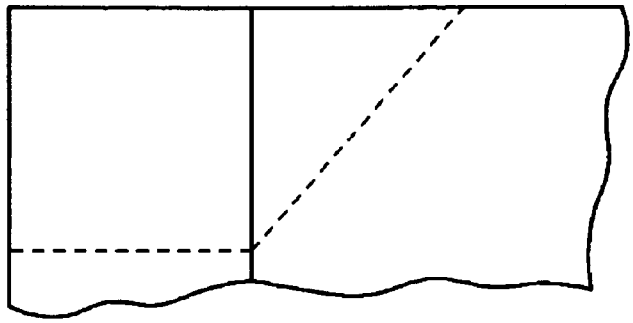
FIG. 15 is partial view of a sealed gusset in the package of FIG. 14.
Figure 14:
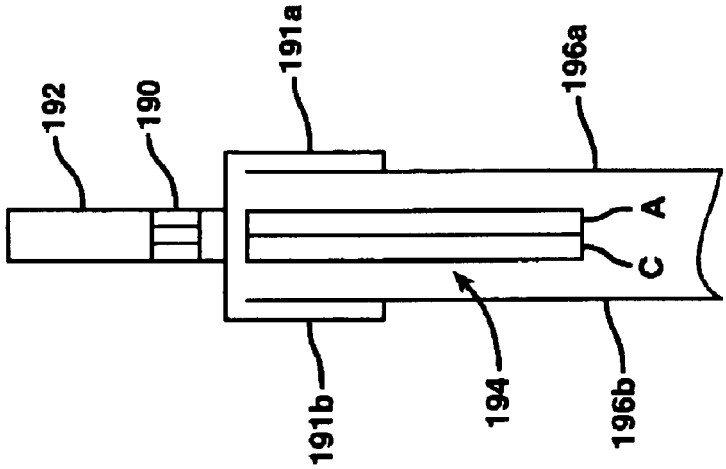
FIG. 14 is a side view of a pouch with a pinch zipper.
Figure 13:
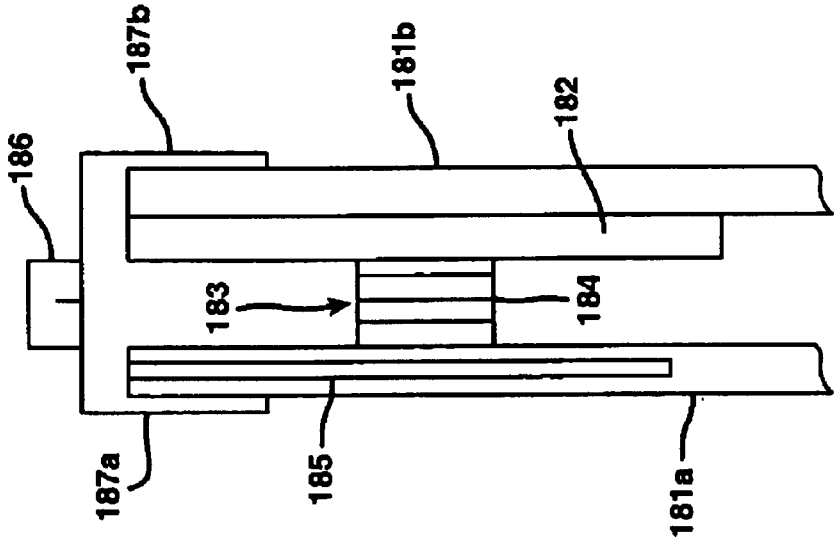
FIG. 13 is a view as in FIG. 12, and showing a slide zipper attachment.
Figure 16:
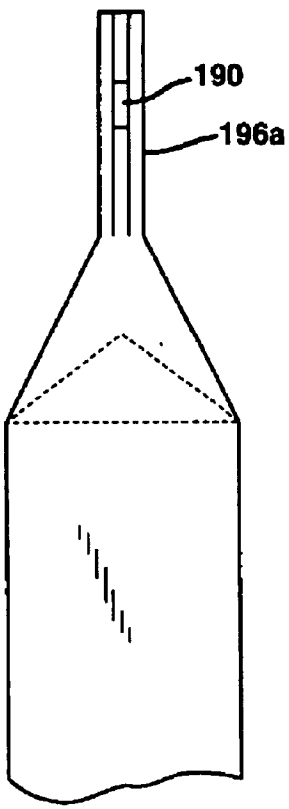
FIG. 16 is a side view of a gusset in the package of FIG. 14.

Referring to FIGS. 14 to 16, the panel can also be used with a slide zipper. In this embodiment, the zipper 186 is applied as a strip to the top portion of the pouch after the gussets are made (FIG. 13). The zipper is applied, after product filling, either in line on a vertical form/fill/seal machine, or on ancillary equipment. The zipper is preferably introduced laterally to the pouch, and then sealed to the pouch. Alternatively, the zipper can be introduced vertically from above the pouch. The attachment flanges 187*a* and 187*b* of the zipper are applied to the outside surfaces of the top of the back and front walls 181*a* and 181*b* respectively of the pouch after the gussets 185 have been formed and sealed to make a wide mouth opening (FIGS. 9 and 13). To produce this type of pouch, the discrete panel 182 is applied to the lay-flat film prior to advancing the film over the forming mandrel (see FIG. 12). The panel serves as a carrier for an easy open or easy peel film strip 183. A slide zipper must have a hermetic or security seal below the zipper if accidental or intentional opening of the pouch is to be prevented. The pouch film has an A/A sealant construction, and the panel has an A/C construction. The "A" side of the panel will bond to only the "A" side of the pouch film 181 (see FIGS. 12 and 13). The "C" surface of the panel does not bond to the pouch film. To the "C" surface, a film strip 183 is applied which has an A/B/B/C construction. The "C" surface of the film strip 183 forms a strong bond to the "C" surface of the panel. The "A" surface forms a strong bond to the "A" surface of the pouch film. The B/B layers form a peelable seal 184 (see FIGS. 12 and 13). To open the pouch, the zipper 186 is opened and the B/B interface, i.e. bond 184, is pulled apart without tearing the pouch. The slide zipper is applied to the top portion of the pouch after a cut is made above the panel separating it from the adjacent or next pouch in the series of pouches being produced in the VFFS process.

Alternatively, the B/B layers and interface can be replaced by a low peel strength adhesive (layer "x" herein), such that film strip 183 has an A/X/C construction.

In still another alternative, the B/B layers and interface can be replaced by a layer having low cohesive strength (layer "y" herein), such that film strip 183 has an A/Y/C construction.

EXAMPLE 5

Front Wall Reclosable Pouch with Externally Mounted Pinch Zipper

A pinch zipper 190 with a hermetic tear strip 192 attached thereto can also be applied in the same manner as the slide zipper. The zipper is applied, after product filling, either in line on a vertical form/fill/seal machine, or on ancillary equipment. In this embodiment, the discrete panel 194 serves to block the sealing of the inside front and back walls of pouch film 196 having A/A sealants. The zipper 190, with a hermetic cut or tear strip 192, is applied after the gussets are formed, and as the gussets are sealed. The zipper strip with flanges 191*a* and 191*b* is applied over the top portion of the pouch. A seal is applied which bonds the zipper flanges to the exterior pouch walls, and forms the internal seal (FIG. 14). This step takes place after the pouch has been cut above the strip separating it from the adjacent or next pouch in the series of pouches being produced in the VFFS process. Panel 194 will adhere to the inner surface of front wall 196*a* via surface A; panel 194 will not adhere to the inner surface of back wall 196*b* because of surface C.

The gusset seal and panel configuration in the above embodiments results in a finger-thumb hold on the sides of the pouch to facilitate dispensing of the ingredients and holding of the pouch (FIGS. 15 and 16). This requires that the sealing of the outer surfaces of the gussets to each other is not blocked. It should be noted that the upper portion of FIG. 16 is generalized for the sake of simplicity, but should be viewed as including the structure of FIG. 14. The finger-thumb hold is thus provided in the area of the pouch where the gussets are sealed together.

EXAMPLE 6

Side Wall Reclosable Pouch with Internally Mounted Pinch Zipper

Figure 17:
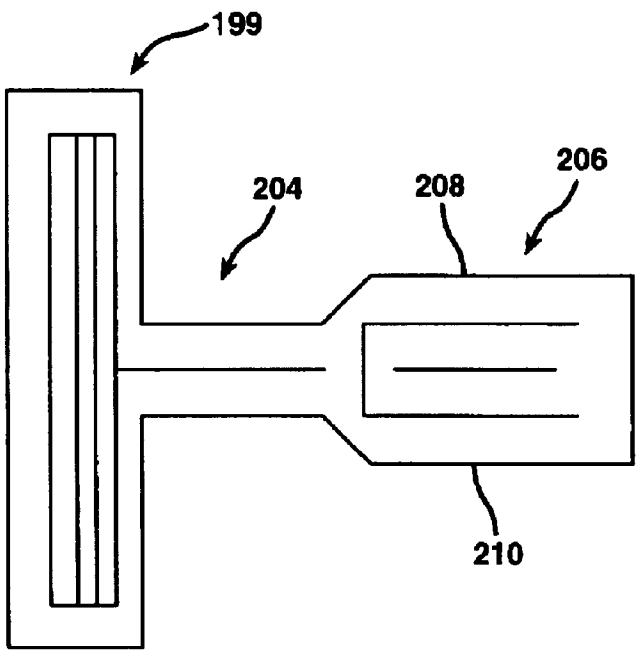
FIG. 17 is a top view of a pouch with a side pour spout, in a sealed condition.

Referring to FIG. 17, by using the panel to carry a "pinch" zipper as described in Example 2, a reclosable pouch can be positioned in a side gusset of a gusseted pouch. The spout exhibits a pouring functionality similar to the pour spout of a gable top rigid paperboard container, such as a paperboard milk carton.

Figure 19:
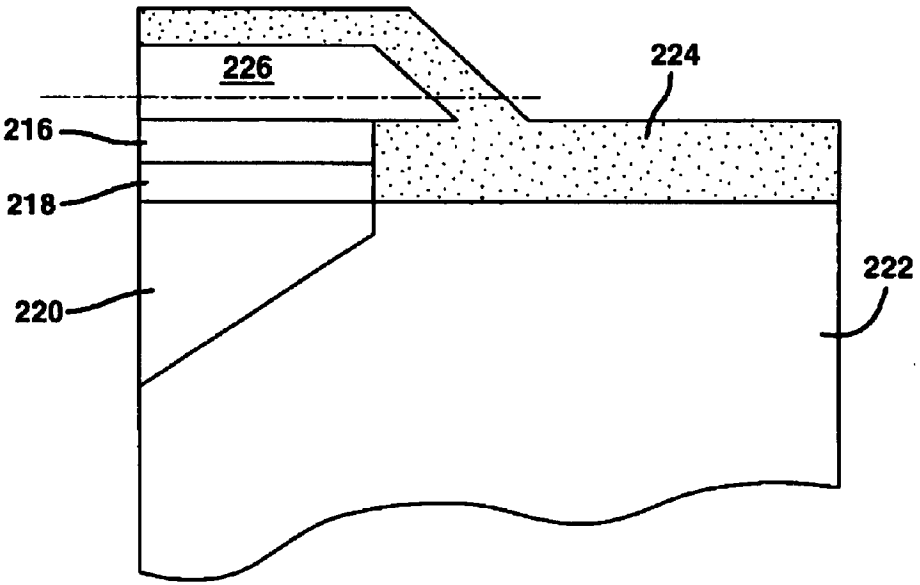
FIG. 19 is an elevational view of an alternative embodiment.
Figure 22:
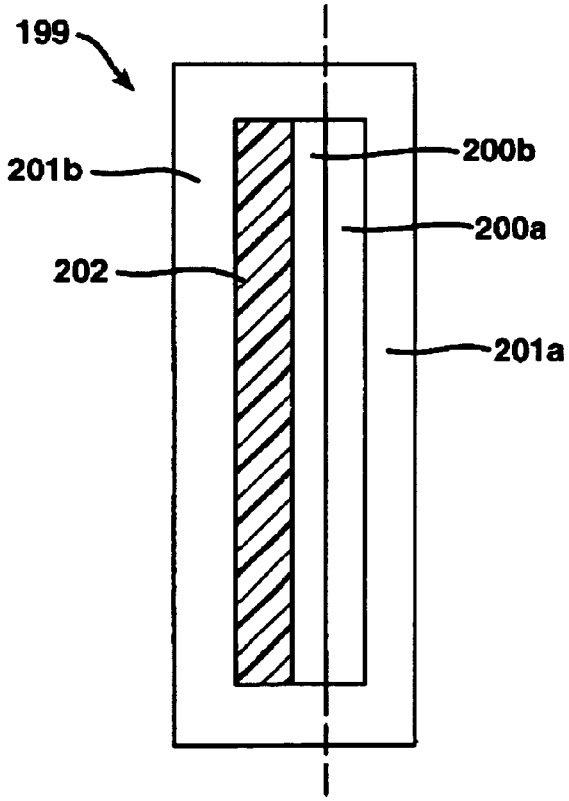
FIG. 22 is an expanded top view of a portion of the pour spout end of the pouch of FIG. 17.

The discrete panel is applied to the lay-flat film prior to advancing the film around the forming mandrel. The panel is applied such that it will be positioned in a side gusset of the final pouch when the gusset is formed. Rather than making a seal across the entire front and back panels of the pouch as described in Example 2, a "T" shape seal is made. FIG. 17 illustrates this embodiment, showing a pour spout region 199, a middle sealed region 204, and an opposite sealed gusseted region 206. FIG. 22 is a view of the pour spout region 199 of FIG. 17. In FIG. 22, a zipper 200 having portions 200*a* and 200*b* is disposed in a pour spout within a side gusset of a gusseted pouch. The vertical dotted line defines the interface between zipper portions, and thus the interface of the male/female interlocks of the zipper. Surface or portion 200*a* adheres upon sealing to pouch wall 201*a*; surface or portion 200*b* adheres upon sealing to one surface of panel 202. The opposite surface of panel 202 adheres upon sealing to pouch wall 201*b*. The gusset "wings" or members on the opposite side of the top portion of the pouch, collectively shown as 206 in FIG. 17, are sealed to the front and back walls 208 and 210 respectively of the pouch. The seal is thus made to the junction of the side gusset in which the pour spout is formed. This includes the middle region 204 of the top portion of the pouch. The discrete panel is not used to block the sealing of the front and back walls in this area. In the panel area, a seal is applied which seals the back flanges of the zipper to the inside surface of the side gusset. The panel facing this surface blocks the seal resulting in an opening when the zipper is separated. To provide a hermetic seal, a seal 214 is applied above or below the panel (see FIG. 18) using an easy tear or cut-off strip 226 (FIG. 19). To open the pouch, the hermetic seal 214 is removed, and the zipper opened.

Figure 18:
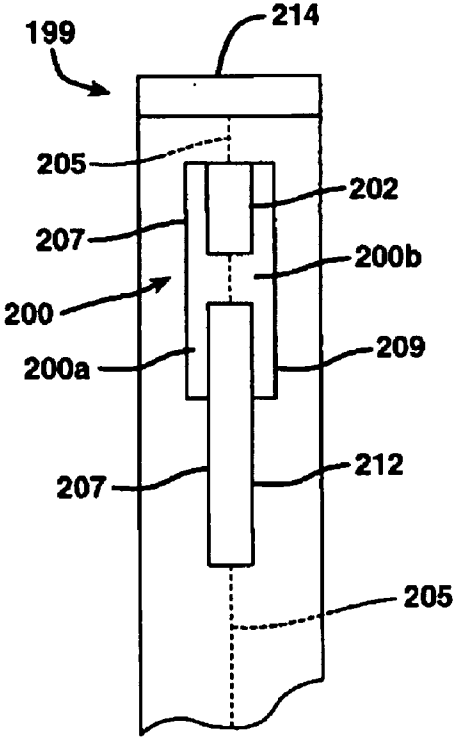
FIG. 18 is an edge view of the pour spout end of the pouch of FIG. 17.

FIG. 18 shows an elevational view of pour spout region 199. A split panel having members 202 (visible in top views in FIGS. 17 and 22) and 212, and zipper 200 with zipper flanges 200*a* and 200*b* are shown. Optional easy-open peelable seals 207 and 209 are shown. Broken line 205 indicates the unsealed interface between the front and back walls of the pouch.

FIG. 19 shows an alternative embodiment in which panel member 216 is like panel member 202 of FIG. 18; zipper 218 is like zipper 200 of FIG. 18; and panel member 220 is like panel member 212 of FIG. 18. The back wall of the pouch is designated as 222. A hermetic seal 224 located at the top portion of the pouch provides a raised tear area, at 226, to provide access to the pouch. A pouch can be torn through area 226, along a path designated by the dashed line, to provide access to the pouch.

Figure 20:
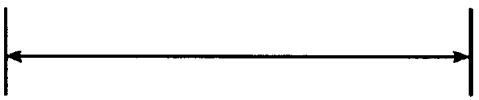
FIG. 20 is a representation of the portion of the pouch of FIG. 19 having a total seal.

FIG. 20 shows the portion of the top area of the pouch that is totally sealed.

Figure 21:
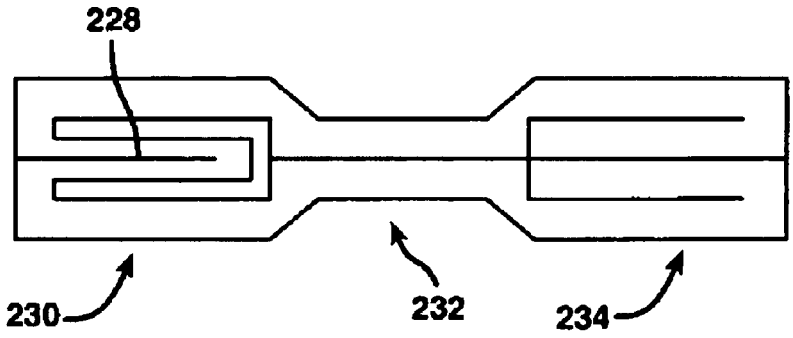
FIG. 21 is a top view of the pouch of FIG. 19.

FIG. 21 is a top view of the pouch of FIG. 19. The gusset 228 is unsealed. Regions 230, 232, and 234 are like regions 199, 204, and 206 respectively of FIG. 17.

EXAMPLE 7

Panel Placement Process

Figure 23:
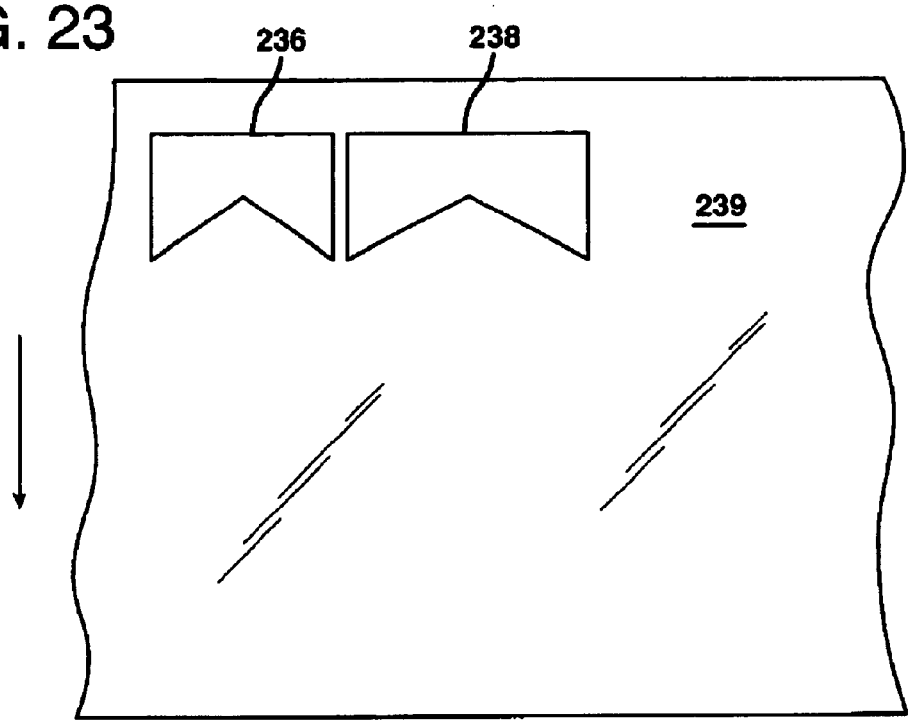
FIG. 23 is a plan view showing a lay-flat film with two panels each capable of being formed into a pour spout.

FIG. 23 shows placement of two discrete panels on a lay-flat film 239. Panel 236 is placed in a position that will ultimately form part of a side pour spout of a pouch; panel 238 is placed in a position that will ultimately form part of a front (wide mouth) pour spout of a pouch. In practice, it is unlikely that a pouch would be made that had both such panels juxtaposed on the same section of lay-flat film, but the invention includes such an embodiment. The panels 236 and/or 238 are applied in a vertical or horizontal plane while the film is flat. This would occur e.g. between the rollstock unwind and the forming mandrel of a VFFS unit. The panels can be applied by heat sealing, RF (radio frequency) sealing, an adhesive or other known methods for bonding two materials together. The arrow of FIG. 23 shows the direction of travel of the lay-flat film 239.

Alternatively, discrete panels can be placed on lay-flat film at the site where the film is manufactured, or at some other site, other than the processor site, where discrete panels are applied to a lay-flat film. This is typically less preferable than the procedure described immediately above, because as the lay-flat film with panels is rolled up, the presence of the panels will cause unevenness in the take-up roll.

EXAMPLE 8

Side Wall Reclosable Pouch with Externally Mounted Pinch Zippers

Figure 24:
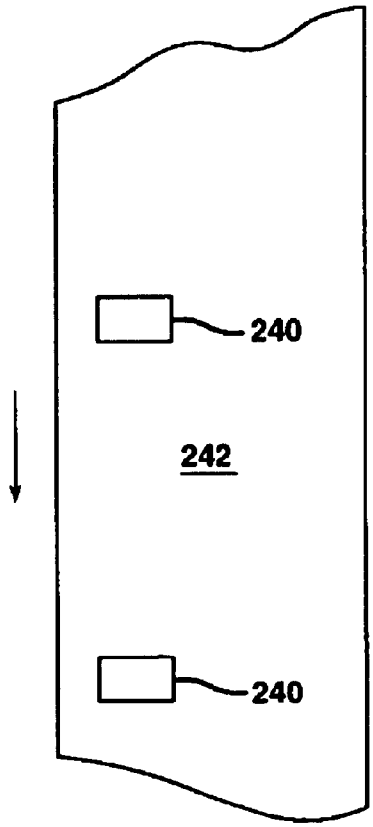
FIG. 24 is a plan view of a lay-flat film with a plurality of panels disposed thereon.
Figure 25:
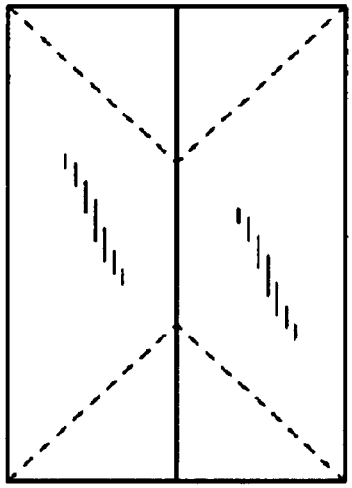
FIG. 25 is a bottom view of a pouch.
Figure 26:
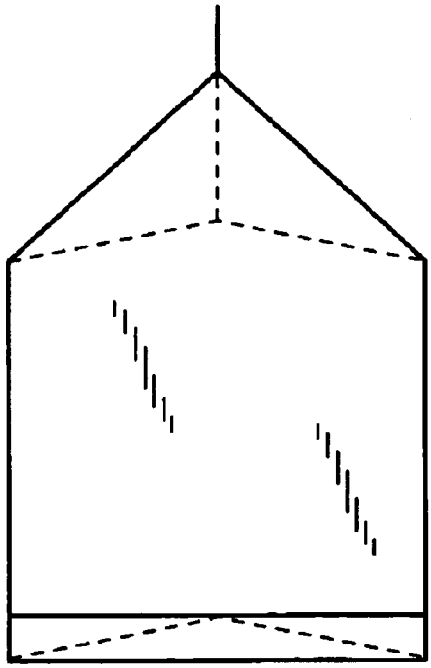
FIG. 26 is a side view of a pouch.
Figure 28:
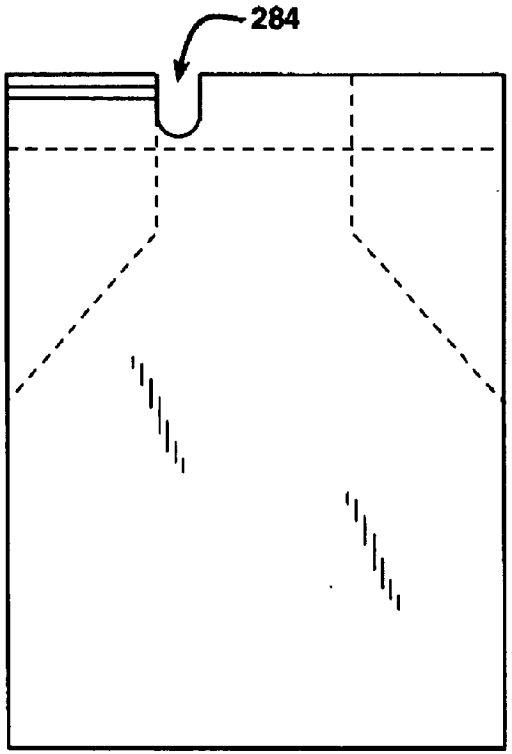
FIG. 28 is a front view of a pouch with a side pour spout.
Figure 27:
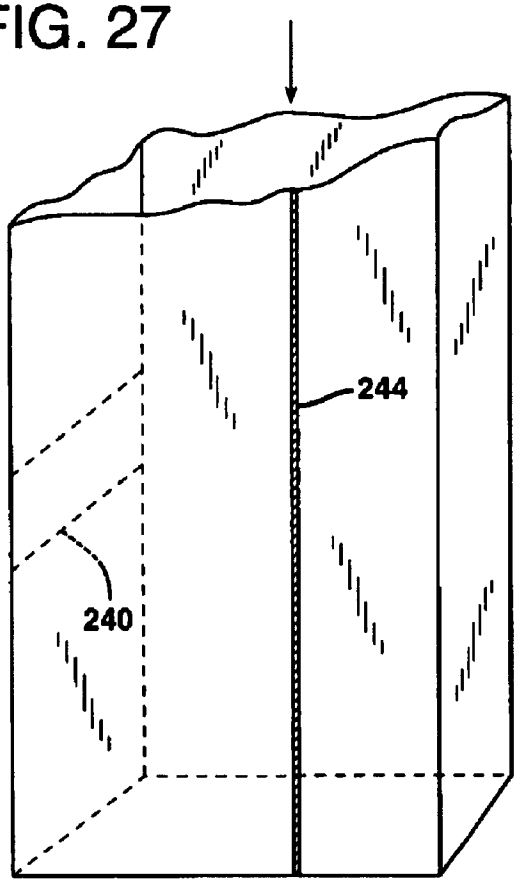
FIG. 27 is a perspective view of a formed tube with a panel attached thereto.
Figure 29:
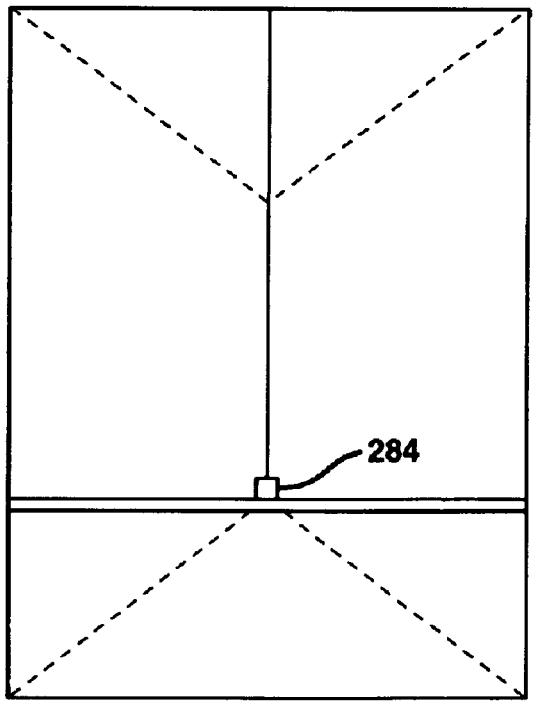
FIG. 29 is a top view of the pouch of FIG. 28.
Figure 30:
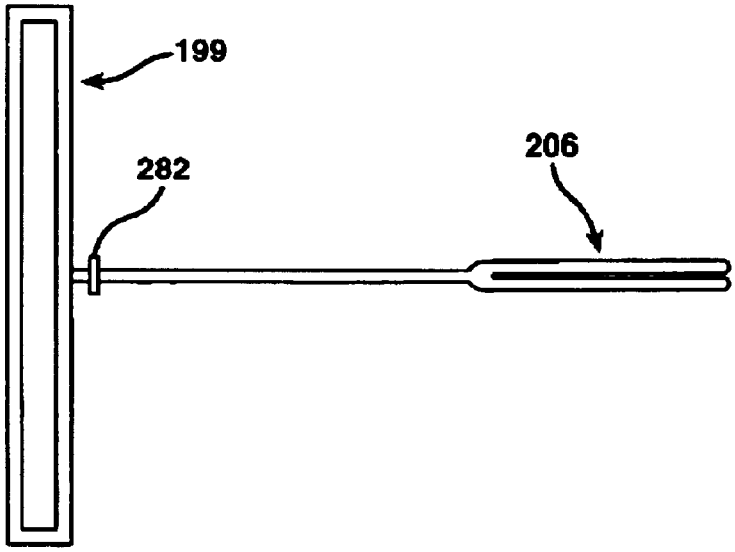
FIG. 30 is another a top view of the pouch of FIG. 28.
Figure 44:
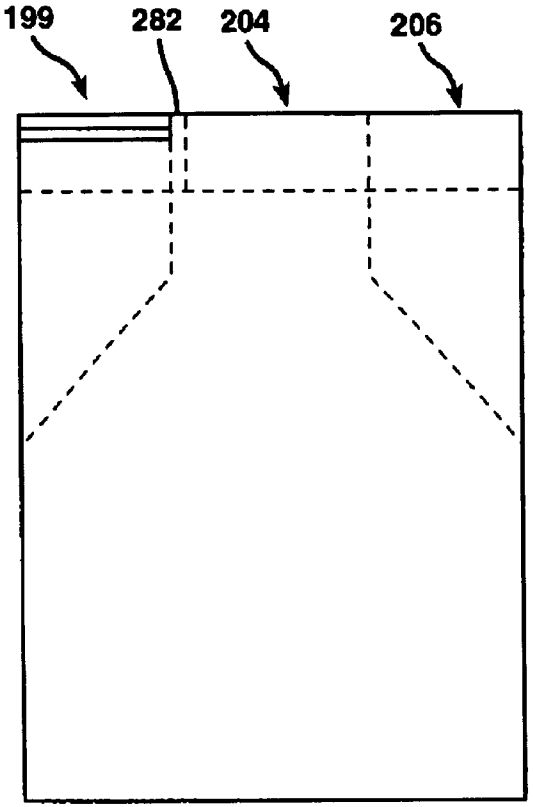
FIG. 44 is a front view of a pouch with a side wall reclosable zipper.
Figure 43:
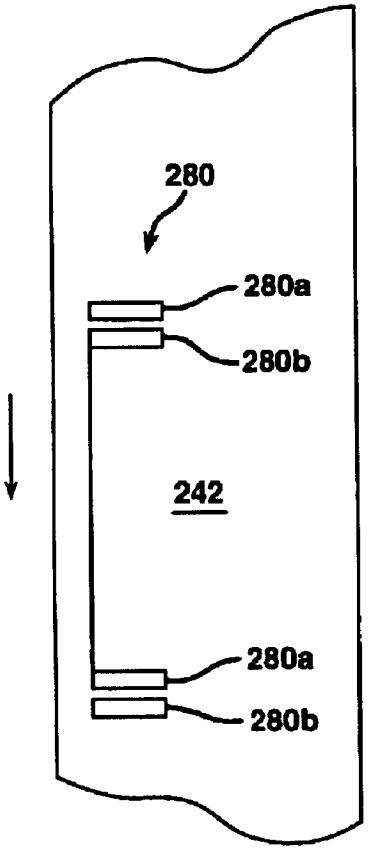
FIG. 43 is a plan view of a lay-flat film with a plurality of split panels disposed thereon.

The reclosable pouch is incorporated into the gable (gusset) side panel of a gusseted package. The zipper is applied, after product filling, either in line on a vertical form/fill/seal machine, or on ancillary equipment. The process begins with the attachment of a discrete panel 240 on a lay-flat film 242 prior to advancing the film through a tube-forming shoe (see FIG. 24). This panel has a sealant layer on the top surface, which forms a first seal to the film surface that forms the inside surface of the pouch. (FIG. 43 shows a similar arrangement, but with a split panel 280 having members 280*a* and 280*b*). The bottom side of the panel has a horizontal zone that contains an easy-peel adhesive that peelably adheres to the inside surface of the pouch. This same surface of the panel also has a horizontal zone above and below the easy peel adhesive zone, which does not seal to the inside surface of the pouch. Alternatively, the entire bottom side of the panel contains an easy-peel adhesive that peelably adheres to the inside surface of the pouch. The film with the panel attached is advanced, in the direction of the arrow of FIG. 24, and fed over a conventional forming shoe and down over a conventional mandrel. A vertical seal 244 (FIG. 27) is applied and a tube is formed. The tube moves downward to a horizontal sealing bar and a transverse seal is applied. The tube is filled with product. At this point, a gusset is formed in the tube, by means of a pair of wheels that reciprocate towards and away from the vertical line representing the path of travel of the tube. A bottom seal is formed. When the gusset is formed, it is formed so that the previously applied panel is positioned in the side wall of the leading pouch, with each end of the panel being positioned at the inside edges of the side gussets. The opposite panel is flattened against the end of the seal bar and positioned perpendicular to the opposite gusset forming a "T" (see FIG. 30). A seal is applied to a defined area of these two flanges. The sealing step seals the panel to the backside of the non-gusseted flange. This seal and the easy peel seal that was previously applied results in a hermetic seal in this flange. A section behind the panel with the panel is cut away in the shape of a "U" and a horizontal portion of the non-gusseted flange is removed by cutting (see FIG. 28). A zipper is fed over the non-gusseted flange and heat-sealed to the front and backsides. To finalize the package, the non-gusseted flange is folded creating a gusset. A paper label or strip is applied to the folded flange creating a non-heat sealed gusset. The height of the zipper containing flange and the permanent gusset panel are equal. This balances the appearance of the package, which is critical for consumer acceptance. FIGS. 25 and 26 show a bottom and side view respectively of the pouch. FIG. 29 shows a top view of the pouch. The dashed lines at the lower part of FIG. 29 disclose that the pouch wall trails off toward the bottom of the pouch on this side of the pouch. FIG. 30 shows the top portion of a pouch wherein the top seals have been made. The gussets of region 206 of FIG. 17 are shown in FIG. 30 as sealed together. A slit 282 permits a seal bar, to be described below, to be advanced to a position where the "T" seal can be made. Slit 282 is also shown in FIG. 44. It should be understood that the slit can be simply a cut or tear in the top portion of the pouch, thus not requiring the removal of any pouch material. The alternative to slit 282 is a U-shaped cut-out 284 (see FIG. 28). A slit is preferred because it aesthetically is more attractive, having less of a visual impact on the package appearance than the U-shaped cut-out. Also, when employing a slit, no scrap material is generated in the VFFS packaging environment.

Figure 31:
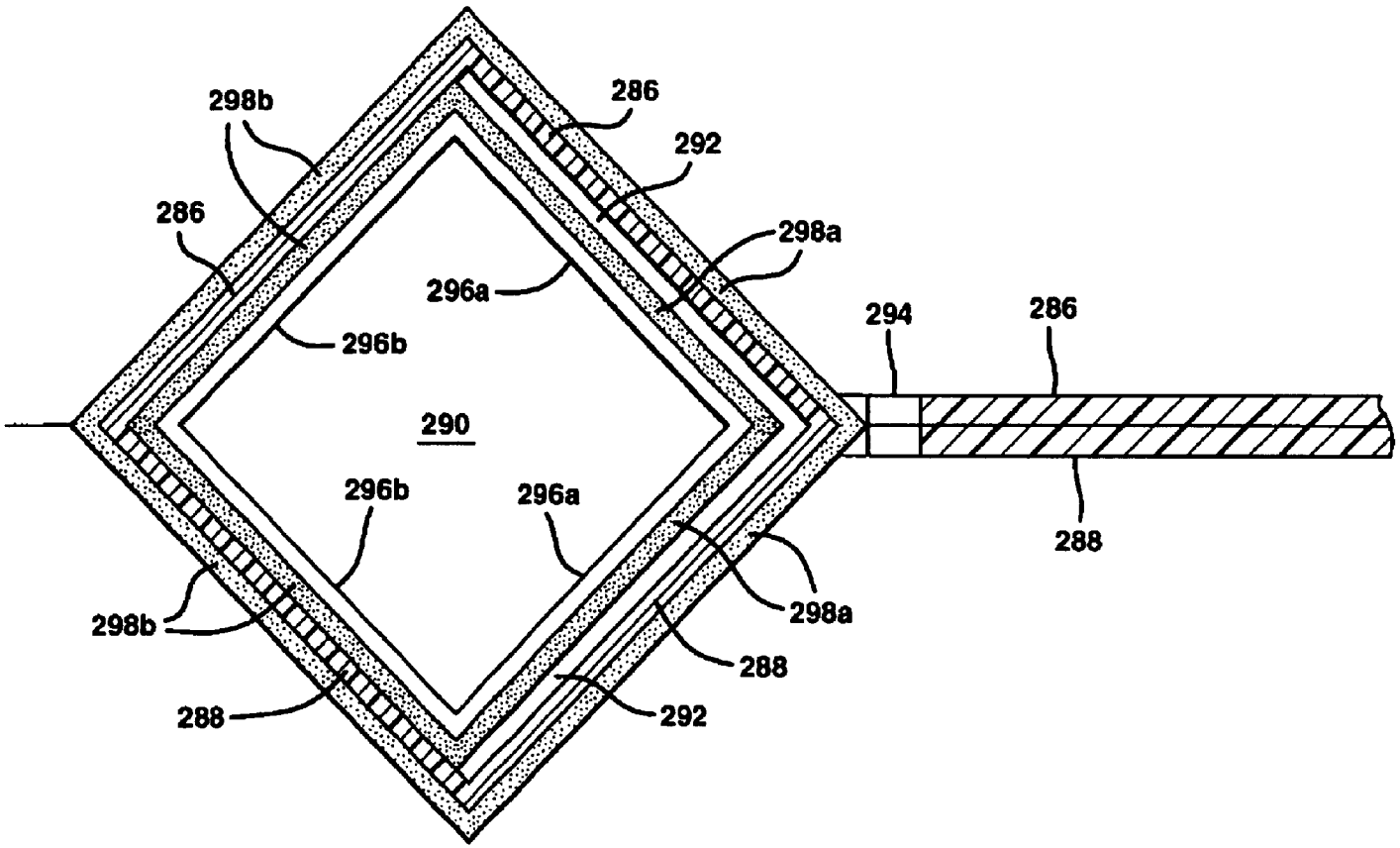
FIG. 31 is a view of a pour spout in the open condition.

FIG. 31 shows a pour spout disposed in a side gusset of a pouch, the pour spout in an open position ready for pouring. In one preferred embodiment, portions of the front wall 286 and back wall 288 of the pouch define an approximately diamond shaped orifice 290. Within the pour spout, a discrete panel 292 is disposed on portions of the inner surfaces of walls 286 and 288 that are at the "near" end of the pour spout, i.e. closest to U-shaped cut out 294. Panel 292 helps the pour spout function effectively, by adding rigidity and shape to the spout. Panel 292 also acts to block the sealing together of the pouch walls when the "T" seal is made, by providing an incompatible surface that will not seal to the material of the pouch wall. This blocking function insures the openability of the pour spout in the final pouch. Zipper 296, including male interlock 296*a* and female interlock 296*b*, is installed by saddling zipper flanges 298*a* and 298*b* over the outside and inside surface of walls 286 and 288, and sealing the zipper flanges to the walls or, where the panel is present, to panel 292. Zipper flanges 298*a* and 298*b* are illustrated in FIG. 31 with a dotted pattern to help distinguish them from the remaining features of the drawing. If desired, a pull tab can be sealed, adhered, or otherwise installed on some portion of the pour spout or any of the components thereof to facilitate the initial and/or subsequent opening of the spout. After initial opening, the spout can be closed and reopened repeatedly as needed.

Although FIG. 31 shows a schematic top view of a reclosable pouch with the various described components, it should be understood that this type of package will in a preferred embodiment be made such that the male/female interlock portions of the zipper will be disposed vertically above the discrete panel ("vertically" when the pouch is filled and in its normal standing position). Also, to accommodate the vertical height of the zipper, the portion of walls 286 and 288 that form part of the pour spout, that is, the portion of the front and back walls that appear to the left of the U-shaped cut out 294 in FIG. 31, will be cut lower than the rest of walls 286 and 288 when the tubular film is transversely cut in a VFFS process. This is done largely for aesthetic reasons, so that the top of the final pour spout will be vertically even with the remainder of the top of the pouch. Thus, the transverse seal will be a step-shaped seal.

In an alternative and less preferred embodiment, the male/female interlocks of the zipper will also be disposed vertically above the discrete panel. However, the portion of walls 286 and 288 that form part of the pour spout, that is, the portion of the front and back walls that appear to the left of the U-shaped cut out 294 in FIG. 31, will be at the same vertical height as the rest of walls 286 and 288 when the tubular film is transversely cut in a VFFS process. This simplifies the transverse seal in the sense that it is a straight cut, not a step cut, but is less appealing aesthetically, since the top of the final pour spout will be vertically higher than the remainder of the top portion of the pouch.

FIG. 31 should therefore be viewed in terms of either of the above described embodiments.

Figure 32:
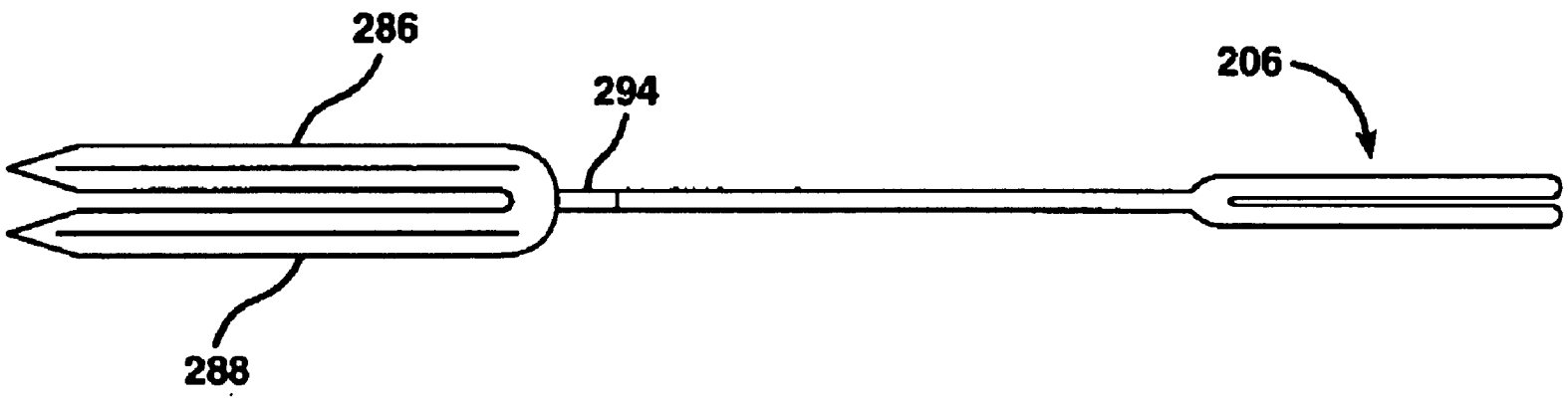
FIG. 32 is a view of the spout of FIG. 31 in a closed condition.

FIG. 32 shows the pour spout in the closed condition (several of the pour spout components not shown for sake of clarity).

The final configuration includes a permanent gusset on one side wall, and a folded gusset on the opposite side wall, with the opposite side wall having an internal easy peel seal and a zipper (FIG. 32). The folded gusset is optionally held together with a paper label or other retention device that is easily torn or otherwise opened in order to access the zipper for the purpose of opening the pouch. The easy peel internal seal serves as a hermetic seal prior to opening.

Figure 34:
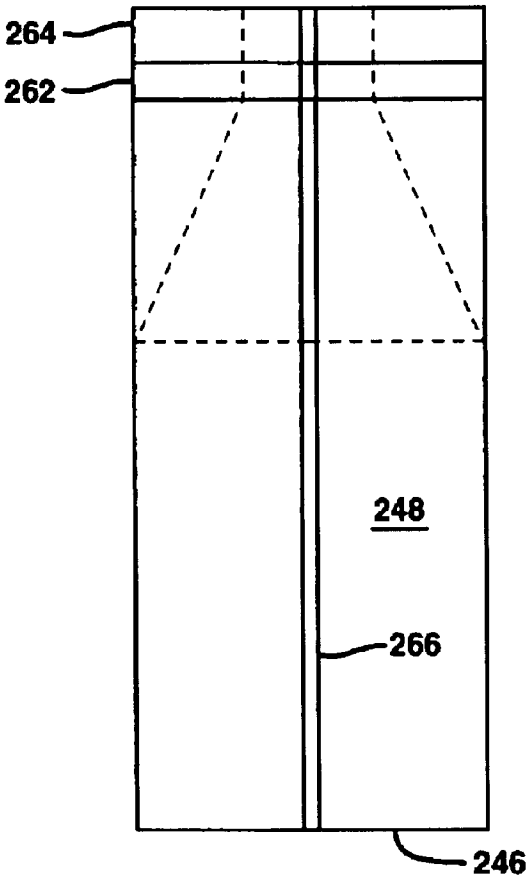
FIG. 34 is a schematic front view of the empty pouch of FIG. 33.
Figure 33:
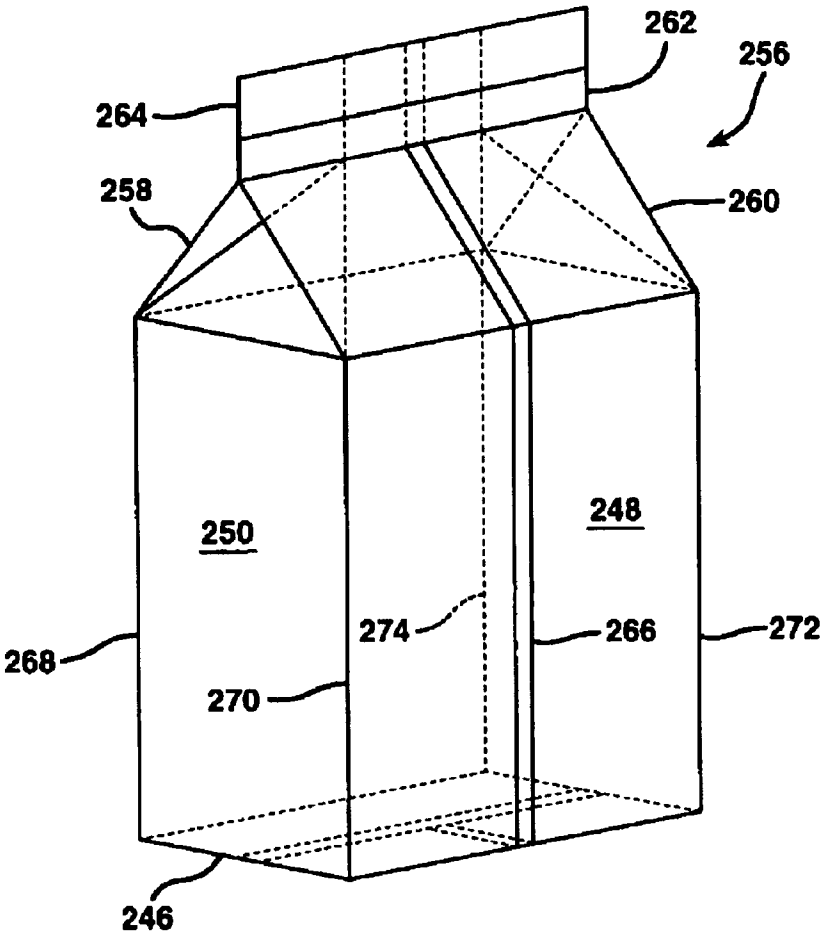
FIG. 33 is a schematic perspective view of an empty pouch.
Figure 37:
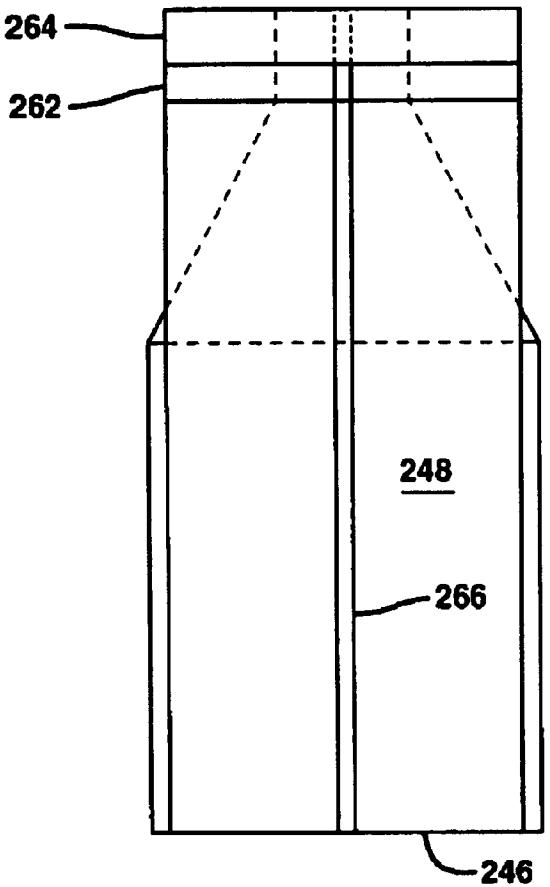
FIG. 37 is an alternative schematic front view of the pouch of FIG. 33 in a filled condition.

FIG. 33 shows a perspective view of a preferred embodiment of a reclosable pouch with reclosable pour spout in accordance with the invention. The pouch includes a base 246, a front wall 248, side walls 250 and 252 (see also FIG. 35), a back wall 254, and a gable top 256 including side gussets 258 and 260 formed in the side walls 250 and 252 respectively, and a pour spout 262 including a discrete panel, and a reclosable zipper. A hermetic strip 264 is disposed at the top portion of the package. Alternatively, the hermetic strip can be disposed below the pour spout 262. Longitudinal seal 266 (which may be a lap or fin seal) runs down the front wall of the pouch. Bottom seals forming the base are shown in phantom. FIG. 34 is a schematic front view of the pouch of FIG. 33, with the pouch in an ideal vertical position. FIG. 37 is similar to FIG. 34, but shows a lateral extension of the side walls that more realistically reflects the bulge caused by a product that fills the pouch.

Figure 35:
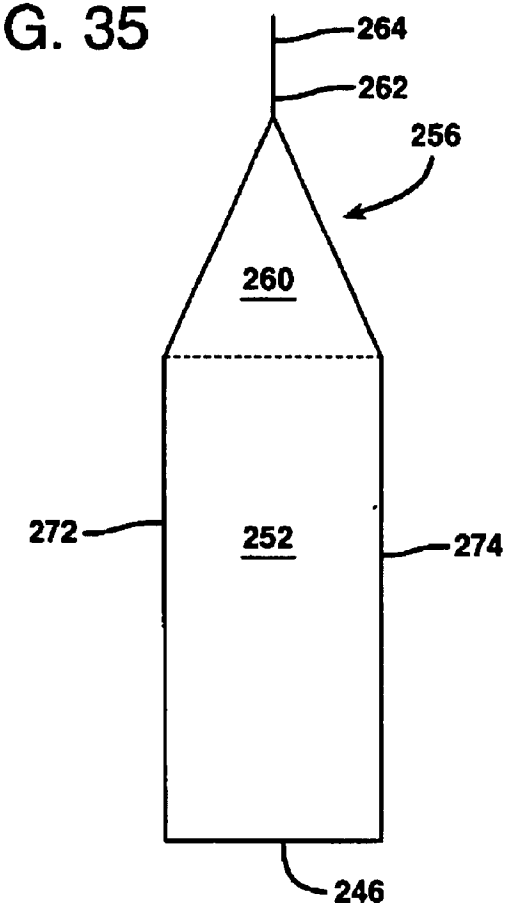
FIG. 35 is a schematic side view of the empty pouch of FIG. 33.
Figure 38:
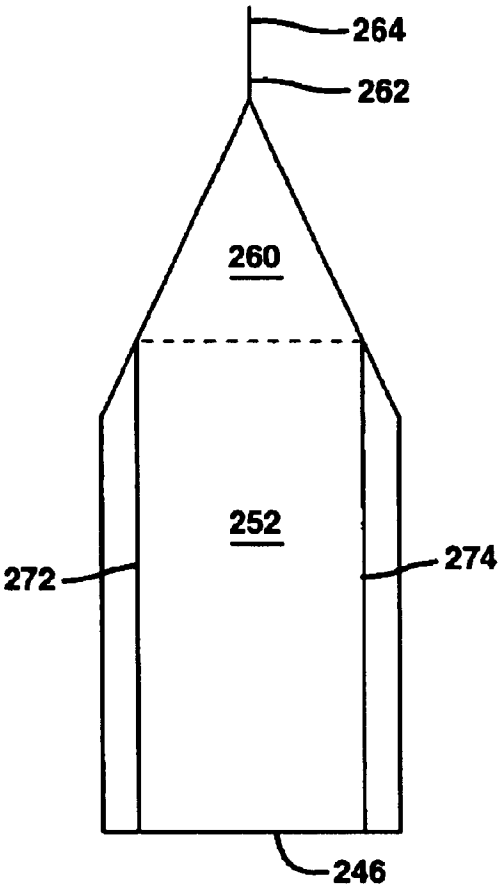
FIG. 38 is an alternative schematic side view of the pouch of FIG. 33 in a filled condition.

Likewise, FIG. 35 is a schematic side view (looking at the side wall 252 observable only in phantom in FIG. 33) of the pouch of FIG. 33, with the pouch in an ideal vertical position. FIG. 38 is similar to FIG. 35, but shows a lateral extension of the side walls that more realistically reflects the bulge caused by a product that fills the pouch.

Figure 36:
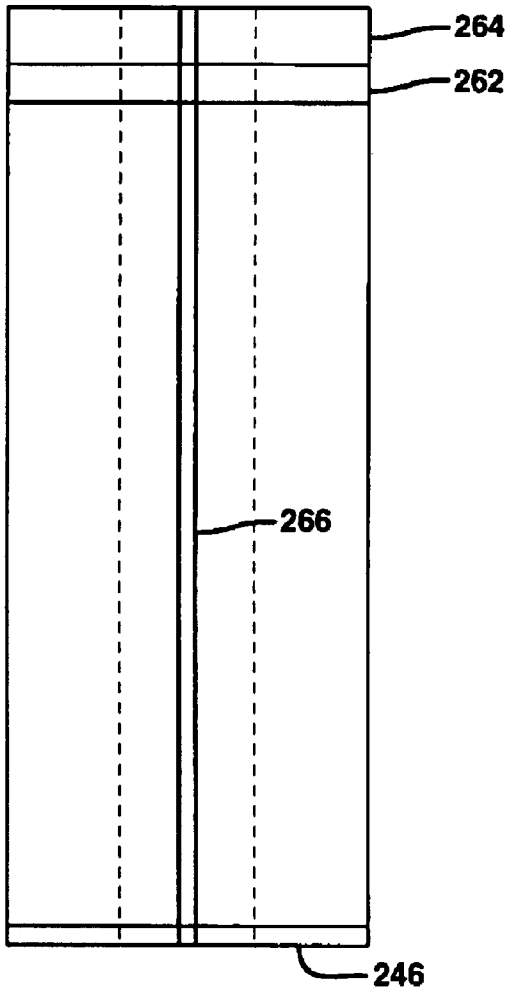
FIG. 36 is a lay-flat view of the empty pouch of FIG. 33.

FIG. 36 is a lay-flat view of the pouch of FIG. 33.

It should be understood that the discrete panel used in either a wide-mouth pour spout in the front wall of a pouch, or a side pour spout in a side gusset of a pouch, can be installed in other ways from those disclosed in the examples herein. The panel can be adhered to the portion of the side pour spout forming the outer extremity of the pouch, that is farthest from the center of the top portion of the pouch, instead of toward the center of the top portion of the pouch. A plurality of panels can also be employed utilizing any combination of the above. The best position for the panel or panels will be determined based on the size and shape of the pouch, the nature of the product to be packaged, the nature and needs of the end user, and other factors.

EXAMPLE 9

Method and Apparatus for Making a Reclosable Pouch

Figure 39:
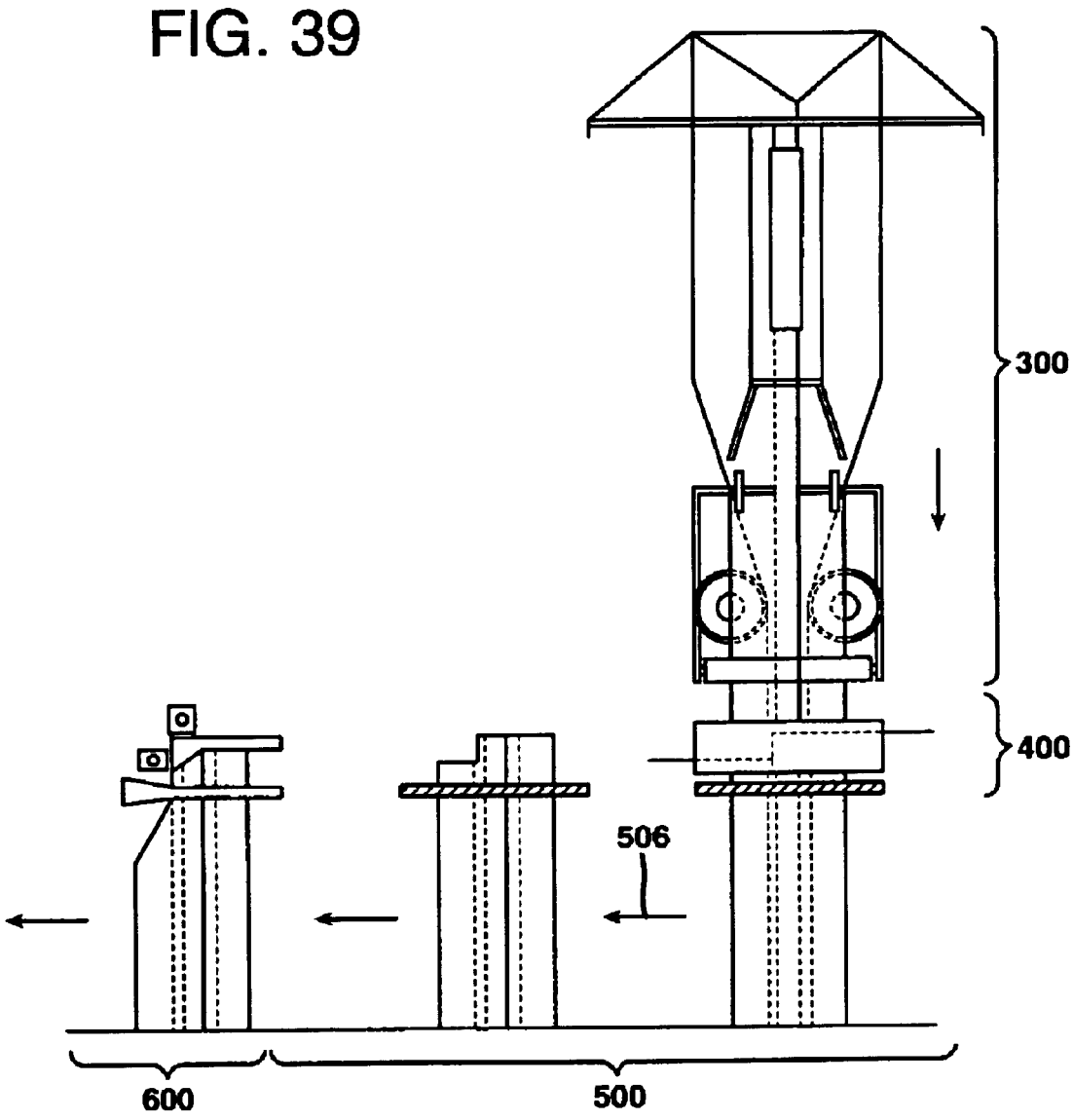
FIG. 39 is an elevational view of an apparatus for making the pouch of FIG. 33.

FIG. 39 shows an apparatus and process for making a reclosable pouch with a pour spout in a side gusset of the pouch. A pouch forming station is shown generally at 300; a transverse seal station is shown generally at 400; a transport station is shown generally at 500; and a "T" seal station is shown generally at 600.

Figure 40:
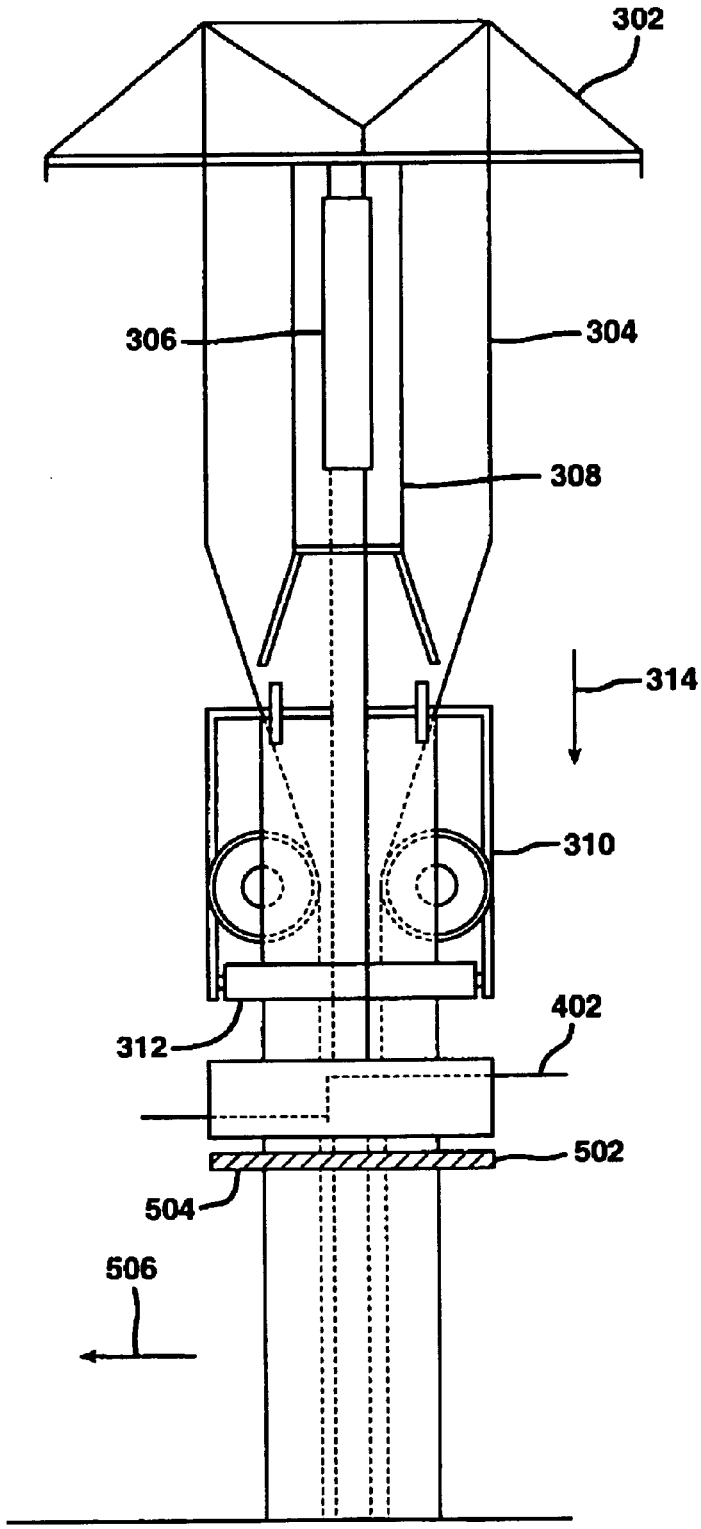
FIG. 40 is an enlarged view of a portion of the apparatus of FIG. 39.
Figure 41:
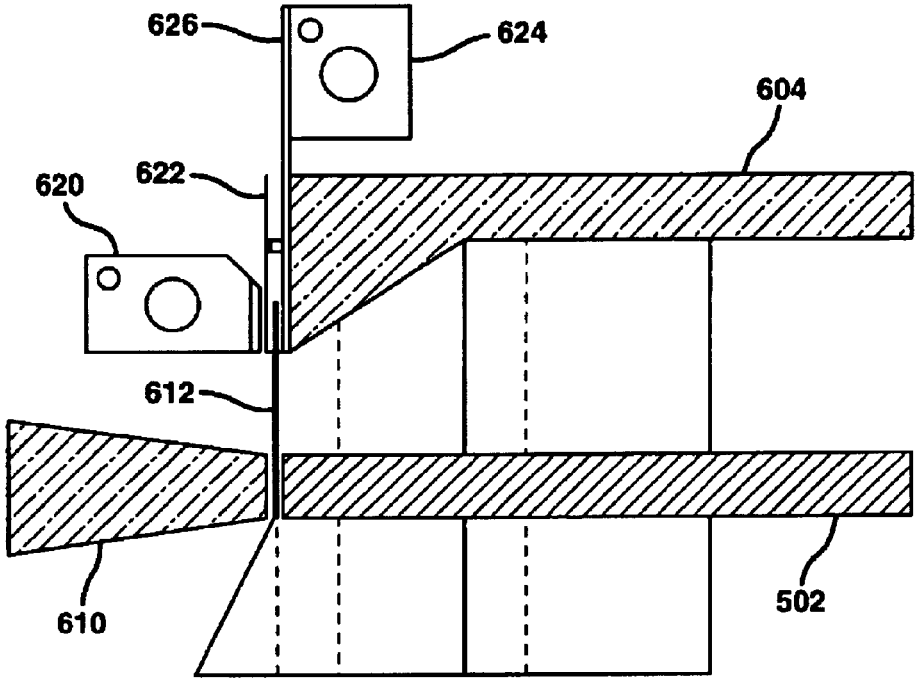
FIG. 41 is an enlarged view of another portion of the apparatus of FIG. 39.

FIG. 40 shows an expanded view of the pouch forming station 300. Lay-flat film 304 (only a short segment of which is shown for the sake of clarity), carrying a plurality of spaced apart panels or split panels as described above, is advanced over a forming collar 302 to form a tubular film 305. The tubular film is then drawn downwardly, in the direction indicated by arrow 314, across mandrel 308. During this step, the tubular film is longitudinally (preferably vertically) sealed by a longitudinal sealing means 306 to make a fin or lap seal. Mandrel 308 accommodates a fill tube (not shown for sake of clarity) for filling a dry flowable product, or other product, into a pouch. Mandrel 308 can be of any suitable geometry. For example, it can have a circular, elliptical, or polygonal cross section. It can have a square cross section. A pair of gusset wheels 310 create gussets in both side walls of the tubular film. These wheels can move transversely toward and away from the tube. Thus, the wheels can be moved away from the tube to allow product to be filled into the pouch formed from the tube. The equipment components described herein up to this point for FIG. 40 are conventional, and those skilled in the art will be familiar with such systems.

A pair of rollers 312 can optionally be included. Rollers can prove useful in voiding the area around the top seal, especially when wet flowable products are to be packaged in the pouch of the invention. For dry flowable products, rollers may be less effective in providing this voiding function. Rollers can also be beneficial in that they help flatten the pouch, and form a bottom "stop" to allow for and support the filling of the next pouch in the filling sequence.

A step transverse seal is made by means for sealing 402. The tube is preferably cut at the same time, by a means for cutting a step seal. The first pouch made in a production run will thus have a bottom step seal that can optionally be suitably flattened at the bottom of the package. A fill tube (not shown) fills the tubular bottom sealed pouch. For subsequent packages in the production run, the sealing step will result in the formation of a bottom stepped seal for each filled tube, and a stepped cut in the top of the package for subsequent sealing and installation of the zipper containing pour spout as described herein. In this embodiment, no film scrap is generated between the pouches.

Before the tubular film is transversely cut, holding means 502 and 504 grasp the tubular film below the step cut. The holding means can be pairs of clamps, pairs of vacuum cups, or the like. The holding means can serve to vertically support the filled tube, or can be used in conjunction with a conveying means such as a belt or platen, disposed under each filled tube, to support the weight of each tube, and/or convey same to the T seal station 600. FIG. 40 shows the front member of a pair of holding means 502, and the front member of a pair of holding means 504.

The thus supported pouch is conveyed or carried in the direction of arrow 506, along path 500, to station 600.

Figure 42:
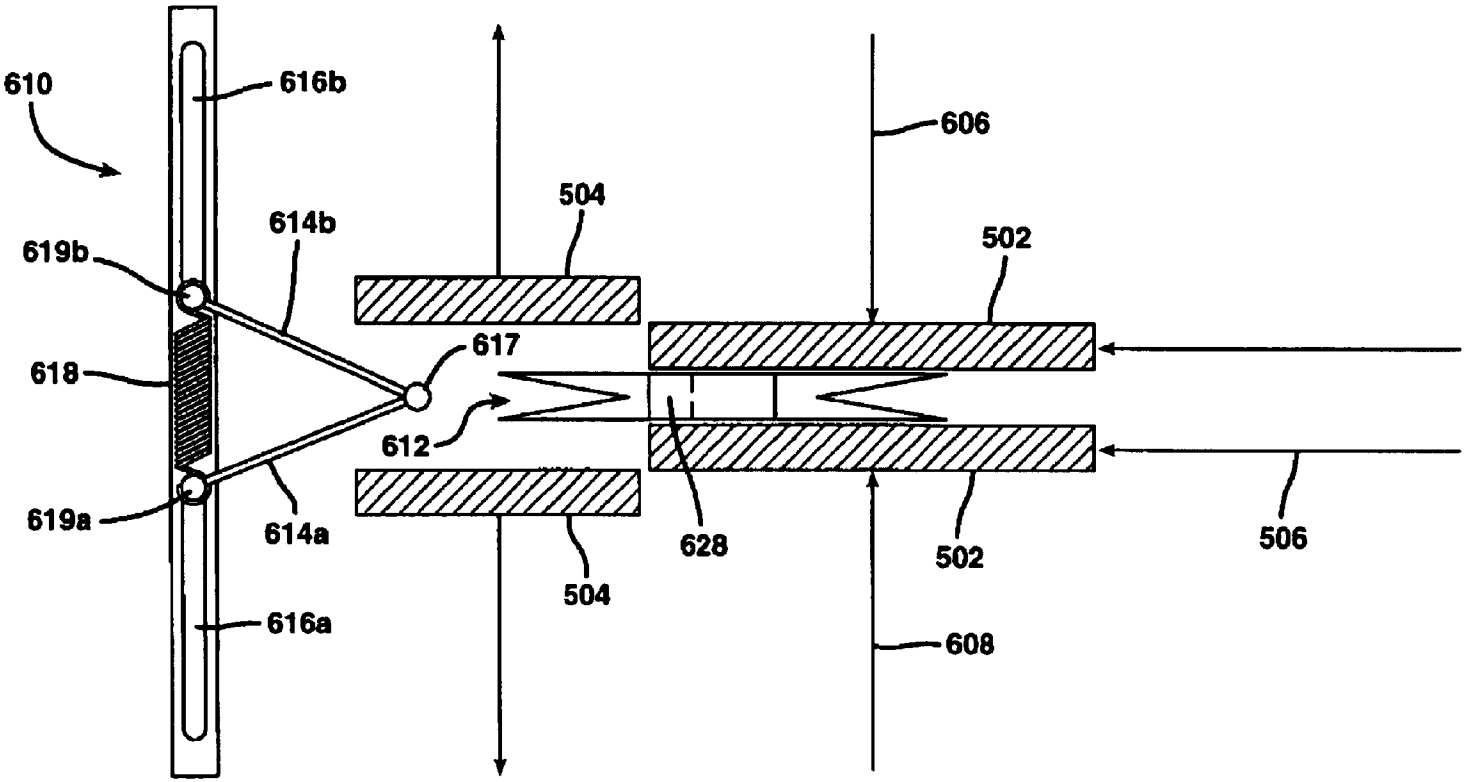
FIG. 42 is a side view of a device for sealing the pouch of FIG. 33.

With holding means 502 firmly holding a portion of the top portion of the filled tube, spreader device 610 is advanced to open and flatten gusset 612 against the sides of holding means 502. At the same time, or prior to the advance of spreader device 610, holding means 504 are retracted from the filled pouch to allow the spreader device 610 to advance. As spreader device 610 advances, arms 614*a,b*, connected to a common leading pivot 617, will engage the side walls gusset 612 and begin to press against and spread the pouch walls of the gusset. At the same time, pivot points 619*a,b* will respond by moving laterally along races 616*a,b* respectively against the tension of spring 618. The gusset 612 is thus flattened, forming a "T" with respect to the remainder of the top portion of the pouch wall. A zipper 622 is then installed on the now flattened "T" of gusset 612 of the pouch wall in a saddle arrangement as shown. The zipper can be introduced from above the pouch or, more preferably, from the side of the pouch, by means of a zipper installing device 624. Device 624 carries a plate 626 that carries the zipper 622 by passing across the flattened gusset, in the area of the U-shaped slot 628 (see FIG. 42). A holding means 604, which can be a pair of clamps, pair of vacuum cups, or the like engages and holds the portion of the top of the filled pouch corresponding to middle seal region 204 and opposite gusset region 206 of FIG. 17, and middle seal region 232 and opposite gusset region 234 of FIG. 21. Seal bar 620 is advanced laterally, at a height vertically above the spreader device 610, to seal the flattened "T" gusset 612 now carrying the zipper, as shown in FIG. 21, such that the flanges of zipper 622 sealingly adhere to respective sides of the flattened "T" gusset 612. The side of clamp 604 will act as an anvil or backing bar for seal bar 620.

Although the spreader device 610 is described as "advancing" toward the gusset 612, those skilled in the art will understand that the gusset 612 can in fact be moved toward the spreader device 610 to accomplish the flattening of gusset 612, or else some combination of the two steps can be employed. Thus, the spreader device and gusset 612 are moved relative to each other to accomplish the flattening of gusset 612.

Likewise, although the seal bar 620 is described as "advancing" toward the device 624, plate 626, and holding means 604, those skilled in the art will understand that the device 624, plate 626, and holding means 604 can in fact be moved toward the seal bar 620 to accomplish the installation of zipper 622 on gusset 612, or else some combination of the two steps can be employed. Thus, the seal bar 620, and device 624, plate 626, and holding means 604, are moved relative to each other to accomplish the installation of zipper 622 on flattened gusset 612.

After sealing is completed, the seal bars and spreader device are retracted, and the finished pouch can be put into distribution or storage, advanced for further processing, etc. A slit or U-shaped cut out, as disclosed above, can be made in the top portion of the pouch before or during the T sealing step just described, as a separate operation or simultaneous with one of the sealing or cutting steps disclosed herein, by any suitable process.

EXAMPLE 10

Method and Apparatus for Making a Reclosable Pouch

An apparatus and process for making a reclosable pouch with a pour spout in a front wall of the pouch is essentially like that of Example 9 and FIGS. 39 to 44. Two differences are that (1) a straight rather than stepped bottom seal is made, and (2) after the transverse seal is made and the holding means engage the filled pouch, the pouch is rotated 90° along its vertical axis. The pouch can thus be advanced to be sealed along its top portion by introducing a zipper using the same apparatus as described for Example 9.

Figure 45:
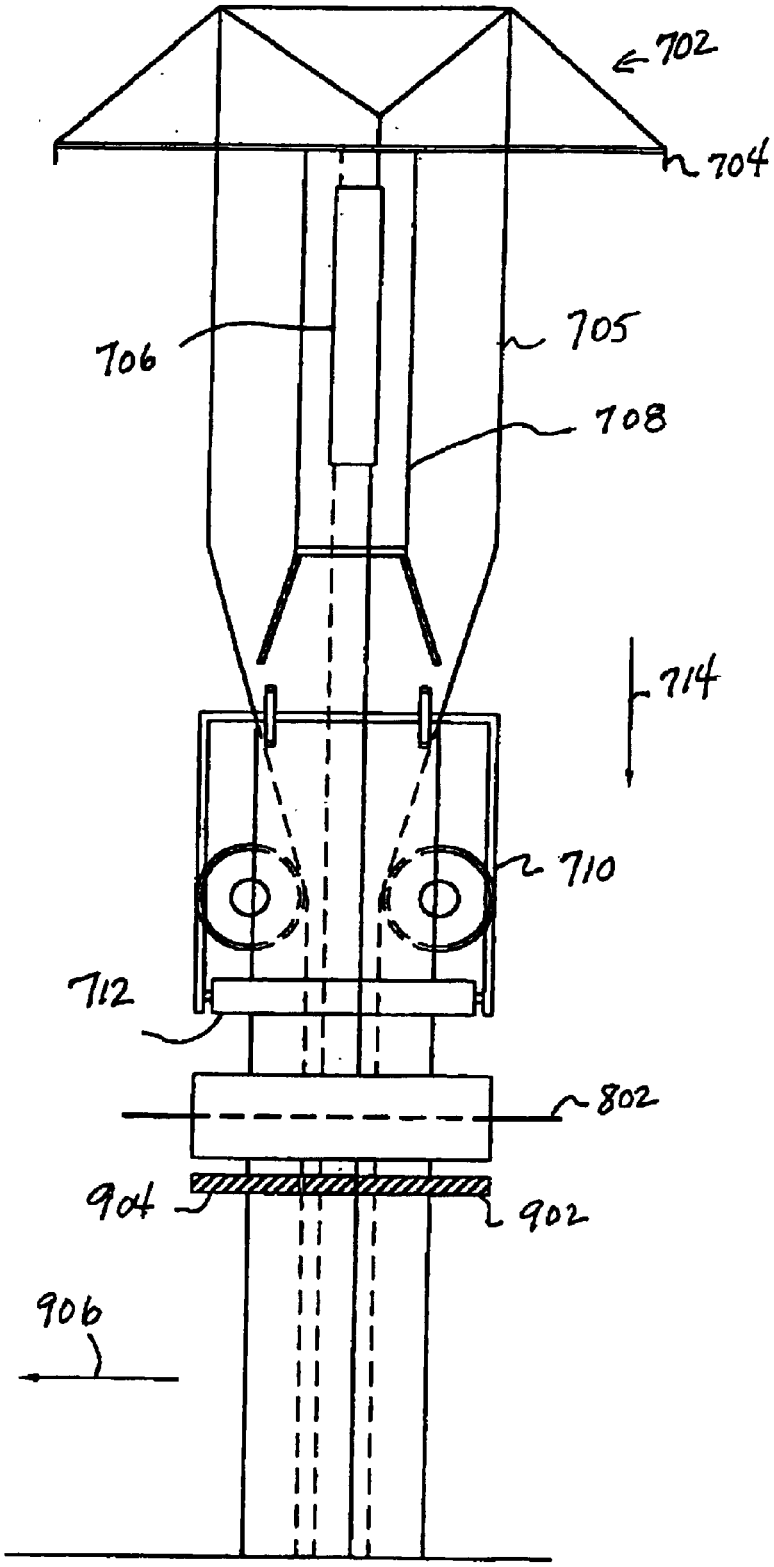
FIG. 45 is an enlarged view of a portion of an apparatus for making a pouch.

FIG. 45 shows an expanded view of a pouch forming station. Lay-flat film 704 (only a short segment of which is shown for the sake of clarity), carrying a plurality of spaced apart panels or split panels as described above, is advanced over a forming collar 702 to form a tubular film 705. The tubular film is then drawn downwardly, in the direction indicated by arrow 714, across mandrel 708. During this step, the tubular film is longitudinally (preferably vertically) sealed by a longitudinal sealing means 706 to make a fin or lap seal. Mandrel 708 accommodates a fill tube (not shown for sake of clarity) for filling a dry flowable product, or other product, into a pouch. Mandrel 708 can be of any suitable geometry. For example, it can have a circular, elliptical, or polygonal cross section. It can have a square cross section. A pair of gusset wheels 710 create gussets in both side walls of the tubular film. These wheels can move transversely toward and away from the tube. Thus, the wheels can be moved away from the tube to allow product to be filled into the pouch formed from the tube. The equipment components described herein up to this point for FIG. 45 are conventional, and those skilled in the art will be familiar with such systems.

A pair of rollers 712 can optionally be included. Rollers can prove useful in voiding the area around the top seal, especially when wet flowable products are to be packaged in the pouch of the invention. For dry flowable products, rollers may be less effective in providing this voiding function. Rollers can also be beneficial in that they help flatten the pouch, and form a bottom "stop" to allow for and support the filling of the next pouch in the filling sequence.

A straight transverse seal is made by means for sealing 802. The tube is preferably cut at the same time, by a means for cutting a straight seal. The first pouch made in a production run will thus have a bottom straight seal that can optionally be suitably flattened at the bottom of the package. A fill tube (not shown) fills the tubular bottom sealed pouch. For subsequent packages in the production run, the sealing step will result in the formation of a bottom straight seal for each filled tube, and a straight cut in the top portion of the package for subsequent sealing and installation of the zipper containing pour spout as described herein. In this embodiment, no film scrap is generated between the pouches.

Before the tubular film is transversely cut, holding means 902 and 904 grasp the tubular film below the step cut. The holding means can be pairs of clamps, pairs of vacuum cups, or the like. The holding means can serve to vertically support the filled tube, or can be used in conjunction with a conveying means such as a belt or platen, disposed under each filled tube, to support the weight of each tube, and/or convey same to a seal station. FIG. 45 shows the front member of a pair of holding means 902, and the front member of a pair of holding means 904.

The thus supported pouch is conveyed or carried in the direction of arrow 906, to a station like station 600 of Example 9. As indicated above, after the holding means engage the filled pouch, the pouch is rotated 90° along its vertical axis. The pouch can thus be advanced to be sealed along its top portion by introducing a zipper using the same apparatus as described for Example 9.

The invention thus provides for the incorporation of a very functional pour spout into the gable section of a gusseted flexible plastic container. It exhibits the same pouring functionality as a gable top rigid paperboard container, such as a paperboard milk carton. The pouch is reclosable; it can be manufactured on vertical form/fill/seal equipment with or without ancillary equipment. The pouch is easy to open. The discrete panel adds rigidity to the spout, and enhances the effectiveness of the spout when pouring a product from the pouch. Rate and volume of dispensing is very controllable. This spout can be closed. Unlike the spout in a conventional paperboard carton, the re-closure features are based on zipper technology. The layout of the male and female zipper interlocks on the side pour spout is different from that of continuous zippers.

The spout design and the method of applying the spout thus permit the production of a gusseted flexible pouch with a reclosure spout on a vertical form/fill/seal machine. In contrast, conventional stand up pouches that are resealable are designed with a screw cap device, or a zipper attached to the top portion and front face of gusset pouches. Neither unit is ideal for dry flowable products. Product flow control is better achieved from the side gusset than from the front panel.

It is to be understood that variations and modifications of the present invention may be made without departing from the scope of the invention.

The present invention can be used for packaging wet flowable and/or pumpable products including low viscosity, fluids (e.g. juice and carbonated beverages), high viscosity fluids (e.g. condiments and sauces), fluid/solid mixtures (e.g. soups), gels; etc. Non-food products such as fertilizers, motor oil and engine additives, dry and wet cosmetics, medicaments, medical powders such as foot and talcum powder, sand, cement, and the like can also be beneficially packaged in pouches of the present invention. The present invention finds particular utility in packaging dry flowable and/or pumpable products. These include very finely divided or comminuted products such as flour and cake mixes; somewhat coarser products such as spices and sugar; and even coarser products such as rice and breakfast cereal. Products with larger particulates such as pet food, and non-food dry flowable and/or pumpable products can be beneficially packaged.

Although the term "pour spout" is used herein, those skilled in the art will understand that these devices can sometimes be used to simply provide access to the contents of the pouch without actually pouring the contents of the pouch. For example, the wide mouth pour spout of some of the embodiments can be opened, and a measuring cup, spoon, or other suitable utensils can be used to remove a desired quantity of product from the pouch.

"Film" is used herein to mean films, laminates, and webs, either multilayer or monolayer, that may be used in connection with the present invention. The FS laminates, such as FS 6055B, sold by Sealed Air Corporation through its Cryovac Division, are examples of packaging materials suitable for the VFFS process. These laminates are described in e.g. U.S. Pat. No. 4,746,562 (Fant), incorporated herein by reference in its entirety.

An alternative laminate is based on SCLAIR (tm) sealant film, an ethylene/alpha-olefin copolymer marketed by DuPont Canada, and described in e.g. U.S. Pat. No. 4,521,437 (Storms), incorporated herein by reference in its entirety. A commercial monolayer film from DuPont Canada is FS-3. A commercial multilayer laminate is CL 303. Many other films and laminates useful for dry or wet fluid packaging are available, and can be beneficially used in the present invention.

"Pouch" herein includes a pouch, a bag, or like containers, either pre-made or made at the point of packaging.

As an alternative to a panel as disclosed herein, a coating can be used that is preferably registered on the lay-flat film at regular intervals. The coating can be applied on-line at e.g. a food processor location, as part of the overall VFFS packaging process. Alternatively, and preferably, the coating is applied by the film manufacturer. The coating can be in any suitable shape and size, and of any suitable composition, as long as it functions as described herein for a panel. Preferred coatings are multi-layer in construction (i.e. will require several applications of the coating to achieve sufficient thickness to function properly in lieu of a discrete panel) and multi-constituent in composition, and must have sufficient thickness to provide uniform transfer of the panel during sealing as disclosed herein. A coating is less preferred than a panel in gusseted pouch applications, because only one side of the coating is effectively available (the other side of the coating being bonded to the panel). In gusseted or non-gusseted pouch applications, coatings can be more troublesome to deal with, because for proper sealing, transfer of the entire panel during the sealing step is critical if a coating is used in lieu of a panel, and the coating is too thin, the coating could break up, thus interfering with the proper functioning of the pouch.

A pouch in accordance with the invention can be premade, e.g. by the film manufacturer, including installation of the discrete panel, or installation of both the panel and the reclosable zipper. In the latter case, the result is a tubing with a panel and zipper installed at one end, which can then be filled at the open end by e.g. the food processor, and then sealed to complete the pouch.

What is claimed is:

1. An apparatus for making a pouch comprises:

a) means for providing a lay-flat film having a first lateral edge and second lateral edge;

b) means for attaching a plurality of lay-fiat discrete panels to the lay-flat film at regular spaced intervals along the length of the film, wherein each lay-flat discrete panel is spaced the same distance from the first lateral edge of the lay-flat film, and each lay-flat discrete panel is adapted to accommodate one of a plurality of reclosable zippers;

c) means for forming the lay-flat film into a tube;

d) means for longitudinally sealing the tube;

e) means for forming a bottom seal on the tube;

f) means for filling the tube with a product; and g) means for sealing a top portion of the tube to form a pouch wherein the pouch includes i) one of the plurality of lay-flat discrete panels, and ii) one of the plurality of reclosable zippers.

2. The apparatus of claim 1 further comprising a first pair of clamps and a second pair of clamps, the first and second pairs of clamps capable of being disposed parallel to the top portion of the tube, with the tube between said pairs of clamps, one end of said first pair of clamps being adjacent to and spaced apart from an end of said second pair of clamps.

3. The apparatus of claim 1 wherein the means for sealing the top portion of the tube to form a pouch comprises a first set of seal bars, and a second set of seal bars disposed perpendicular to the first set of seal bars, such that the first and second set of seal bars form a "T" shaped arrangement.

4. The apparatus of claim 1 comprising a means for opening and flattening a side gusset of the pouch such that the top portion of the pouch forms a "T" configuration.

* * * * *